US009997849B2

(12) United States Patent
Regnier

(10) Patent No.: US 9,997,849 B2
(45) Date of Patent: Jun. 12, 2018

(54) CONNECTOR SYSTEM WITH CABLE BY-PASS

(71) Applicant: Molex, LLC, Lisle, IL (US)

(72) Inventor: Kent E. Regnier, Lombard, IL (US)

(73) Assignee: Molex, LLC, Lisle, IL (US)

( * ) Notice: Subject to any disclaimer, the term of this patent is extended or adjusted under 35 U.S.C. 154(b) by 0 days. days.

(21) Appl. No.: 15/384,561

(22) Filed: Dec. 20, 2016

(65) Prior Publication Data

US 2017/0098901 A1 Apr. 6, 2017

Related U.S. Application Data

(63) Continuation of application No. 14/916,347, filed as application No. PCT/US2014/054100 on Sep. 4, 2014, now Pat. No. 9,553,381.

(60) Provisional application No. 61/873,642, filed on Sep. 4, 2013.

(51) Int. Cl.

| | |
|---|---|
| ***H01R 12/70*** | (2011.01) |
| ***H01R 12/75*** | (2011.01) |
| ***H01R 9/05*** | (2006.01) |
| ***H01R 13/6587*** | (2011.01) |

(52) U.S. Cl.

CPC ..... *H01R 12/7064* (2013.01); *H01R 9/0512* (2013.01); *H01R 9/0515* (2013.01); *H01R 12/75* (2013.01); *H01R 13/6587* (2013.01)

(58) Field of Classification Search

CPC .. H01R 12/721; H01R 12/75; H01R 13/6587; H01R 13/6586

See application file for complete search history.

(56) References Cited

U.S. PATENT DOCUMENTS

| | | | |
|---|---|---|---|
| 3,007,131 | A | 10/1961 | Dahlgren et al. |
| 3,594,613 | A | 7/1971 | Prietula |
| 4,072,387 | A | 2/1978 | Sochor |
| 4,083,615 | A | 4/1978 | Volinskie |
| 4,157,612 | A | 6/1979 | Rainal |
| 4,307,926 | A | 12/1981 | Smith |
| 4,417,779 | A | 11/1983 | Wilson |

(Continued)

FOREIGN PATENT DOCUMENTS

| | | | |
|---|---|---|---|
| DE | 3447556 | A1 | 7/1986 |
| JP | 02-079571 | U | 6/1990 |

(Continued)

OTHER PUBLICATIONS

Amphenol Aerospace, "Size 8 High Speed Quadrax and Differential Twinax Contacts for Use in MIL-DTL-38999 Special Subminiature Cylindrical and ARINC 600 Rectangular Connectors", published May 2008. Retrieved from www.peigenesis.com/images/content/news/amphenol_quadrax.pdf.

(Continued)

*Primary Examiner* — Ross Gushi
(74) *Attorney, Agent, or Firm* — Stephen L. Sheldon

(57) ABSTRACT

A connector system is provided that includes a first connector and a second connector that are both coupled by a cable. Both connectors can be configured with terminal tails that are configured to be press-fit into a circuit board. The first connector includes a first terminal pair and the second connector includes a second terminal pair and the first and second terminal pairs are fixably connected to opposite ends of the cable.

11 Claims, 27 Drawing Sheets

(56) References Cited

U.S. PATENT DOCUMENTS 4,615,578 A 10/1986 Stadler
4,639,054 A 1/1987 Kersbergen
4,679,321 A 7/1987 Plonski
4,697,862 A 10/1987 Hasircoglu
4,724,409 A 2/1988 Lehman
4,889,500 A 12/1989 Lazar
4,924,179 A 5/1990 Sherman
4,948,379 A 8/1990 Evans
4,984,992 A 1/1991 Beamenderfer et al.
5,112,251 A 5/1992 Cesar
5,197,893 A 3/1993 Morlion et al.
5,332,979 A 7/1994 Roskewitsch
5,387,130 A 2/1995 Fedder et al.
5,402,088 A 3/1995 Pierro et al.
5,435,757 A 7/1995 Fedder et al.
5,441,424 A 8/1995 Morlion et al.
5,487,673 A 1/1996 Hurtarte
5,509,827 A 4/1996 Huppenthal et al.
5,554,038 A 9/1996 Morlion et al.
5,598,627 A 2/1997 Saka et al.
5,632,634 A 5/1997 Soes
5,691,506 A 11/1997 Miyazaki et al.
5,781,759 A 7/1998 Kashiwabara
6,004,139 A 12/1999 Dramstad
6,053,770 A 4/2000 Blom
6,083,046 A 7/2000 Wu et al.
6,095,872 A 8/2000 Lang et al.
6,144,559 A 11/2000 Johnson et al.
6,156,981 A 12/2000 Ward et al.
6,203,376 B1 3/2001 Magajne et al.
6,273,753 B1 8/2001 Ko
6,273,758 B1 8/2001 Lloyd
6,366,471 B1 4/2002 Edwards et al.
6,368,120 B1 4/2002 Scherer
6,371,788 B1 4/2002 Bowling et al.
6,452,789 B1 9/2002 Pallotti et al.
6,489,563 B1 12/2002 Zhao et al.
6,535,367 B1 3/2003 Carpenter
6,574,115 B2 6/2003 Asano et al.
6,575,772 B1 6/2003 Soubh et al.
6,592,401 B1 7/2003 Gardner et al.
6,652,296 B2 11/2003 Kuroda et al.
6,652,318 B1 11/2003 Winings et al.
6,685,501 B1 2/2004 Wu et al.
6,692,262 B1 2/2004 Loveless
6,705,893 B1 3/2004 Ko
6,780,069 B2 8/2004 Scherer
6,797,891 B1 9/2004 Blair et al.
6,843,657 B2 1/2005 Driscoll et al.
6,903,934 B2 6/2005 Lo
6,910,914 B1 6/2005 Spink, Jr.
6,916,183 B2 7/2005 Alger et al.
6,955,565 B2 10/2005 Lloyd
6,969,280 B2 11/2005 Chien
6,971,887 B1 12/2005 Trobough
7,004,793 B2 2/2006 Scherer
7,052,292 B2 5/2006 Hsu et al.
7,056,128 B2 6/2006 Driscoll et al.
7,066,756 B2 6/2006 Lange et al.
7,070,446 B2 7/2006 Henry
7,108,522 B2 9/2006 Verelst et al.
7,148,428 B2 12/2006 Meier et al.
7,168,961 B2 1/2007 Hsieh
7,175,446 B2 2/2007 Bright
7,192,300 B2 3/2007 Hashiguchi et al.
7,214,097 B1 5/2007 Hsu et al.
7,223,915 B2 5/2007 Hackman
7,234,944 B2 6/2007 Nordin
7,244,137 B2 7/2007 Renfro et al.
7,280,372 B2 10/2007 Grundy et al.
7,307,293 B2 12/2007 Fjelstad et al.
7,331,816 B2 2/2008 Krohn et al.
7,384,275 B2 6/2008 Ngo
7,402,048 B2 7/2008 Meier et al.
7,431,608 B2 10/2008 Sakaguchi et al.
7,445,471 B1 11/2008 Scherer et al.
7,462,924 B2 12/2008 Shuey
7,534,142 B2 5/2009 Avery
7,549,897 B2 6/2009 Fedder et al.
7,621,779 B2 11/2009 Laurx et al.
7,637,767 B2 12/2009 Davis
7,654,831 B1 2/2010 Wu
7,658,654 B2 2/2010 Ohyama
7,690,930 B2 4/2010 Chen et al.
7,719,843 B2 5/2010 Dunham
7,744,385 B2 6/2010 Scherer
7,744,403 B2 6/2010 Barr
7,744,414 B2 6/2010 Scherer et al.
7,748,988 B2 7/2010 Hori
7,771,207 B2 8/2010 Hamner et al.
7,789,529 B2 9/2010 Roberts
7,819,675 B2 10/2010 Ko et al.
7,824,197 B1 11/2010 Westman
7,857,629 B2 12/2010 Chin
7,857,630 B2 12/2010 Hermant et al.
7,862,344 B2 1/2011 Morgan
7,906,730 B2 3/2011 Atkinson et al.
7,931,502 B2 4/2011 Iida
7,985,097 B2 7/2011 Gulla
7,997,933 B2 8/2011 Feldman
8,018,733 B2 9/2011 Jia
8,036,500 B2 10/2011 McColloch
8,157,573 B2 * 4/2012 Tanaka ..... H01R 13/6471 439/108
8,162,675 B2 4/2012 Regnier
8,187,038 B2 5/2012 Kamiya
8,192,222 B2 6/2012 Kameyama
8,226,441 B2 7/2012 Regnier
8,308,491 B2 11/2012 Nichols et al.
8,337,243 B2 12/2012 Elkhatib et al.
8,338,713 B2 12/2012 Fjelstad et al.
8,398,433 B1 3/2013 Yang
8,419,472 B1 4/2013 Swanger
8,435,074 B1 5/2013 Grant
8,439,704 B2 5/2013 Reed
8,449,312 B2 5/2013 Lan
8,449,330 B1 5/2013 Schroll
8,465,302 B2 6/2013 Regnier
8,480,413 B2 7/2013 Minich
8,517,765 B2 8/2013 Schroll
8,535,069 B2 9/2013 Zhang
8,540,525 B2 9/2013 Regnier
8,553,102 B2 10/2013 Yamada
8,575,491 B2 11/2013 Gundel et al.
8,575,529 B2 11/2013 Asahi
8,597,055 B2 12/2013 Regnier
8,651,890 B2 2/2014 Chiarelli
8,672,707 B2 3/2014 Nichols et al.
8,690,604 B2 4/2014 Davis
8,715,003 B2 5/2014 Buck
8,740,644 B2 6/2014 Long
8,747,158 B2 6/2014 Szczesny
8,753,145 B2 6/2014 Lang
8,758,051 B2 6/2014 Nonen et al.
8,764,483 B2 7/2014 Ellison
8,784,122 B2 7/2014 Soubh
8,794,991 B2 8/2014 Ngo
8,804,342 B2 8/2014 Behziz et al.
8,814,595 B2 8/2014 Cohen et al.
8,834,190 B2 9/2014 Ngo
8,864,521 B2 10/2014 Atkinson et al.
8,888,533 B2 11/2014 Westman et al.
8,905,767 B2 12/2014 Putt, Jr. et al.
8,911,255 B2 12/2014 Scherer et al.
8,926,342 B2 1/2015 Vinther
8,926,377 B2 1/2015 Kirk
8,992,236 B2 3/2015 Wittig
8,992,237 B2 3/2015 Regnier
8,992,258 B2 3/2015 Raschilla
9,011,177 B2 4/2015 Lloyd
9,028,281 B2 5/2015 Kirk
9,035,183 B2 5/2015 Kodama et al.
9,040,824 B2 5/2015 Guetig et al.
9,054,432 B2 6/2015 Yang

(56) References Cited

U.S. PATENT DOCUMENTS

| | | | |
|---|---|---|---|
| 9,071,001 | B2 | 6/2015 | Scherer et al. |
| 9,119,292 | B2 | 8/2015 | Gundel |
| 9,136,652 | B2 | 9/2015 | Ngo |
| 9,142,921 | B2 | 9/2015 | Wanha et al. |
| 9,155,214 | B2 | 10/2015 | Ritter |
| 9,160,123 | B1 | 10/2015 | Pao |
| 9,160,151 | B2 | 10/2015 | Vinther |
| 9,161,463 | B2 | 10/2015 | Takamura |
| 9,166,320 | B1 | 10/2015 | Herring |
| 9,196,983 | B2 | 11/2015 | Saur et al. |
| 9,203,171 | B2 | 12/2015 | Yu |
| 9,209,539 | B2 | 12/2015 | Herring |
| 9,214,756 | B2 | 12/2015 | Nishio |
| 9,214,768 | B2 | 12/2015 | Pao |
| 9,232,676 | B2 | 1/2016 | Sechrist et al. |
| 9,246,251 | B2 | 1/2016 | Regnier |
| 9,277,649 | B2 | 3/2016 | Ellison |
| 9,312,618 | B2 | 4/2016 | Regnier |
| 9,331,432 | B1 | 5/2016 | Phillips |
| 9,350,108 | B2 | 5/2016 | Long |
| 9,356,366 | B2 | 5/2016 | Moore |
| 9,385,455 | B2 | 7/2016 | Regnier |
| 9,391,407 | B1 | 7/2016 | Bucher |
| 9,401,563 | B2 | 7/2016 | Simpson |
| 9,413,090 | B2 | 8/2016 | Nagamine |
| 9,413,112 | B2 | 8/2016 | Helster |
| 9,431,773 | B2 | 8/2016 | Chen |
| 9,437,981 | B2 | 9/2016 | Wu |
| 9,455,538 | B2 | 9/2016 | Nishio |
| 9,484,671 | B2 | 11/2016 | Zhu |
| 9,484,673 | B1 | 11/2016 | Yang |
| 9,490,587 | B1 | 11/2016 | Phillips |
| 9,496,655 | B1 | 11/2016 | Huang |
| 9,515,429 | B2 | 12/2016 | DeGeest |
| 9,525,245 | B2 | 12/2016 | Regnier |
| 9,543,688 | B2 | 1/2017 | Pao |
| 9,553,381 | B2 | 1/2017 | Regnier |
| 9,559,465 | B2 | 1/2017 | Phillips |
| 9,565,780 | B2 | 2/2017 | Nishio |
| 9,608,388 | B2 | 3/2017 | Kondo |
| 9,608,590 | B2 | 3/2017 | Hamner |
| 9,627,818 | B1 | 4/2017 | Chen |
| 9,660,364 | B2 | 5/2017 | Wig et al. |
| 9,666,998 | B1 | 5/2017 | deBoer |
| 9,673,570 | B2 | 6/2017 | Briant |
| 9,812,799 | B2 | 11/2017 | Wittig |
| 2001/0016438 | A1 | 8/2001 | Reed |
| 2002/0111067 | A1 | 8/2002 | Sakurai et al. |
| 2002/0157865 | A1 | 10/2002 | Noda |
| 2003/0064616 | A1 | 4/2003 | Reed et al. |
| 2003/0073331 | A1 | 4/2003 | Peloza et al. |
| 2003/0222282 | A1 | 12/2003 | Fjelstad et al. |
| 2004/0094328 | A1 | 5/2004 | Fjelstad et al. |
| 2004/0121633 | A1 | 6/2004 | David et al. |
| 2004/0155328 | A1 | 8/2004 | Kline |
| 2004/0229510 | A1 | 11/2004 | Lloyd |
| 2004/0264894 | A1 | 12/2004 | Cooke |
| 2005/0006126 | A1 | 1/2005 | Aisenbrey |
| 2005/0093127 | A1 | 5/2005 | Fjelstad et al. |
| 2005/0142944 | A1 | 6/2005 | Ling et al. |
| 2005/0239339 | A1 | 10/2005 | Pepe |
| 2006/0001163 | A1 | 1/2006 | Kolbehdari et al. |
| 2006/0035523 | A1 | 2/2006 | Kuroda et al. |
| 2006/0079102 | A1 | 4/2006 | DeLessert |
| 2006/0079119 | A1 | 4/2006 | Wu |
| 2006/0091507 | A1 | 5/2006 | Fjelstad et al. |
| 2006/0189212 | A1 | 8/2006 | Avery |
| 2006/0194475 | A1 | 8/2006 | Miyazaki |
| 2006/0216969 | A1 | 9/2006 | Bright |
| 2006/0228922 | A1 | 10/2006 | Morriss |
| 2006/0234556 | A1 | 10/2006 | Wu |
| 2006/0238991 | A1 | 10/2006 | Drako |
| 2006/0282724 | A1 | 12/2006 | Roulo |
| 2006/0292898 | A1 | 12/2006 | Meredith |
| 2007/0032104 | A1 | 2/2007 | Yamada |
| 2007/0141871 | A1 | 6/2007 | Scherer |
| 2007/0243741 | A1 | 10/2007 | Yang |
| 2008/0131997 | A1 | 6/2008 | Kim et al. |
| 2008/0297988 | A1 | 12/2008 | Chau |
| 2008/0305689 | A1 | 12/2008 | Zhang et al. |
| 2009/0023330 | A1 | 1/2009 | Stoner et al. |
| 2009/0166082 | A1 | 7/2009 | Liu et al. |
| 2009/0215309 | A1* | 8/2009 | Mongold ..... H01R 12/592 439/495 |
| 2010/0068944 | A1 | 3/2010 | Scherer |
| 2010/0112850 | A1 | 5/2010 | Rao |
| 2010/0159829 | A1 | 6/2010 | McCormack |
| 2010/0177489 | A1 | 7/2010 | Yagisawa |
| 2010/0203768 | A1 | 8/2010 | Kondo |
| 2011/0074213 | A1 | 3/2011 | Schaffer |
| 2011/0080719 | A1 | 4/2011 | Jia |
| 2011/0136387 | A1 | 6/2011 | Matsuura |
| 2011/0177699 | A1 | 7/2011 | Crofoot et al. |
| 2011/0212633 | A1 | 9/2011 | Regnier |
| 2011/0230104 | A1 | 9/2011 | Lang |
| 2011/0263156 | A1 | 10/2011 | Ko |
| 2011/0300757 | A1 | 12/2011 | Regnier |
| 2011/0304966 | A1 | 12/2011 | Schrempp |
| 2012/0003848 | A1 | 1/2012 | Casher et al. |
| 2012/0034820 | A1 | 2/2012 | Lang |
| 2012/0225585 | A1 | 9/2012 | Lee |
| 2012/0246373 | A1 | 9/2012 | Chang |
| 2013/0005178 | A1 | 1/2013 | Straka et al. |
| 2013/0012038 | A1 | 1/2013 | Kirk |
| 2013/0017715 | A1 | 1/2013 | van Laarhoven |
| 2013/0040482 | A1 | 2/2013 | Ngo |
| 2013/0092429 | A1 | 4/2013 | Ellison |
| 2013/0148321 | A1 | 6/2013 | Liang |
| 2013/0340251 | A1 | 12/2013 | Regnier |
| 2014/0041937 | A1 | 2/2014 | Lloyd |
| 2014/0073173 | A1 | 3/2014 | Yang |
| 2014/0073174 | A1 | 3/2014 | Yang |
| 2014/0073181 | A1 | 3/2014 | Yang |
| 2014/0217571 | A1 | 8/2014 | Ganesan et al. |
| 2014/0242844 | A1 | 8/2014 | Wanha |
| 2014/0273551 | A1 | 9/2014 | Resendez |
| 2014/0273594 | A1 | 9/2014 | Jones et al. |
| 2014/0335736 | A1 | 11/2014 | Regnier |
| 2015/0079845 | A1 | 3/2015 | Wanha |
| 2015/0090491 | A1 | 4/2015 | Dunwoody |
| 2015/0180578 | A1 | 6/2015 | Leigh et al. |
| 2015/0270247 | A1 | 9/2015 | Chen et al. |
| 2016/0013596 | A1 | 1/2016 | Regnier |
| 2016/0064119 | A1 | 3/2016 | Grant |
| 2016/0104956 | A1 | 4/2016 | Santos |
| 2016/0181713 | A1 | 6/2016 | Peloza |
| 2016/0190720 | A1 | 6/2016 | Lindkamp |
| 2016/0190747 | A1 | 6/2016 | Regnier |
| 2016/0197423 | A1 | 7/2016 | Regnier |
| 2016/0218455 | A1 | 7/2016 | Sayre |
| 2016/0233598 | A1 | 8/2016 | Wittig |
| 2016/0233615 | A1 | 8/2016 | Scholeno |
| 2016/0336692 | A1 | 11/2016 | Champion |
| 2016/0380383 | A1 | 12/2016 | Lord |
| 2017/0033482 | A1 | 2/2017 | Liao |
| 2017/0033509 | A1 | 2/2017 | Liao |
| 2017/0077621 | A1 | 3/2017 | Liao |
| 2017/0098901 | A1 | 4/2017 | Regnier |
| 2017/0110222 | A1 | 4/2017 | Liptak et al. |
| 2017/0162960 | A1 | 6/2017 | Wanha |
| 2017/0302036 | A1 | 10/2017 | Regnier |
| 2017/0365942 | A1 | 10/2017 | Regnier |
| 2018/0034175 | A1 | 2/2018 | Lloyd |

FOREIGN PATENT DOCUMENTS

| | | | |
|---|---|---|---|
| JP | 2008-041285 | A | 2/2008 |
| JP | 2009-043590 | A | 2/2009 |
| TW | M359141 | U | 6/2009 |
| TW | M408835 | U | 8/2011 |
| TW | 201225455 | A | 6/2012 |
| WO | WO 2008/072322 | A1 | 6/2008 |

(56) References Cited

FOREIGN PATENT DOCUMENTS

| | | |
|---|---|---|
| WO | WO 2012-078434 A2 | 6/2012 |
| WO | WO 2013-006592 A2 | 1/2013 |

OTHER PUBLICATIONS

Hitachi Cable America Inc., "Direct Attach Cables: OMNIBIT supports 25 Gbit/s interconnections". Retrieved Aug. 10, 2017 from www.hca.hitachi-cable.com/products/hca/catalog/pdfs/direct-attach-cable-assemblies.pdf.

"File:Wrt54gl-layout.jpg-Embedded Xinu", Internet Citation, Sep. 8, 2006. Retrieved from the Internet: URL:http://xinu.mscs.edu/File:Wrt54gl-layout.jpg [retrieved on Sep. 23, 2014].

U.S. Appl. No. 61/714,871, dated Oct. 17, 2012, Wig et al.

Agilent, "Designing Scalable 10G Backplane Interconnect Systems Utilizing Advanced Verification Methodologies," White Paper, Published May 5, 2012, USA.

Amphenol TCS, "Amphenol TCS expands the XCede Platform with 85 Ohm Connectors and High-Speed Cable Solutions," Press Release, Published Feb. 25, 2009, http://www.amphenol.com/about/news_archive/2009/58.

* cited by examiner

CONNECTOR SYSTEM WITH CABLE BY-PASS

RELATED APPLICATIONS

This application is a continuation of U.S. application Ser. No. 14/916,347, filed Mar. 3, 2016, now U.S. Pat. No. 9,553,381, which is a national phase of PCT Application No. PCT/US2014/054100, filed Sep. 4, 2014, which in turn claims priority to U.S. Provisional Application No. 61/873,642, filed Aug. 4, 2013.

TECHNICAL FIELD

This disclosure relates to the field of connectors, more specifically to connectors suitable for use at high data rates.

DESCRIPTION OF RELATED ART

Switches, routers and other high performance equipment are used in data/telecom applications and tend to be capable of state-of-the-art performance. One example of the high performance that these devices can provide is the ability to support 100 Gbps Ethernet. This performance can be provided, for example, with a main circuit board that supports some number of processors (e.g., the silicon) and is positioned in a box that supports multiple input/output (IO) connectors (the external interface). QSFP-style connectors, for example, when designed appropriately can support four 25 Gbps channels (transmit and receive) so as to allow for a 100 Gbps bi-directional channel. Due to a number of issues, it is still strongly preferred to use non-return to zero (NRZ) encoding for such channels and therefor the channels need to support (at a minimum) 12.5 GHz signaling frequencies (or about 13 GHz). This means that the channel needs to provide accept loss characteristics up to 13 GHz (naturally, other issues such as cross-talk should be managed to higher frequency levels for a more desirable system).

In any communication channel there is a total loss budget available so as to ensure the signal to noise (s/n) ratio is sufficient. In other words, if a signal is transmitted, the signal needs to have enough power when it is received so that the receiving end can discern the signal from the noise. This s/n ration has started to become a problem because the distance between the silicon and the external interface may be 30-50 cm (or more). Most circuit boards are made of a FR4 laminate, which is a lossy medium. A laminate FR4 based circuit board, for example, tends to have attenuation from the dielectric alone that is about 0.1 dB/inch at 1 GHz and this attenuation tends to increase linearly with frequency. Thus, a FR4 board is expected to have a loss of at least 1.3 dB/inch at 13 GHz (more realistically, given other known losses, a loss of about 1.5 dB/inch is expected) and thus would result in a signal that was 20 dB down at about 15 inches (or more realistically 20 dB down at about 13 inches). Thus, the mechanical spacing required by the switch and router designs makes the use of FR4 impractical (or even impossible) due to the amount of the total loss budget that is used up in the circuit board between the silicon and the external interface.

One possible solution is to use other laminates, such as Nelco, which have a lower loss per inch. The use of other laminates, however, is somewhat undesirable as existing alternatives to FR4 laminates are more costly to implement in a circuit board, especially in the larger circuit boards that tend to be used in high performance applications. And even with the improved laminates the losses are still higher than desired. Therefore, certain applications would benefit from an improved solution that can help improve the attenuation issue.

SUMMARY

A connector system is provided that includes a first connector and a second connector that are both configured with terminal tails that are configured to be press-fit into a circuit board. The first connector includes a first terminal pair and the second connector includes a second terminal pair and the first and second terminal pairs are terminated to opposite ends of a cable that provides substantially improved attenuation performance compared to FR4 laminate circuit boards. The first terminal pair includes tails that are configured to be press-fit into a circuit board in an appropriate pattern. In a configuration the second terminal pair includes contacts that are configured to mate with another connector.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

In a connector system there is inherently some number of interfaces. For example, in a QSFP connector that is attached to a circuit board with a SMT style connection, there is a first interface between a paddle card of a mating connector and a contact of a terminal provided in the QSFP connector. There is also a second interface between the terminal in the QSFP connector and the supporting pad in the circuit board. Thus, a connector inherently has two interfaces, one for the incoming signal and one for the outgoing signal. It has been determined that, particularly for high signaling frequencies, it is desirable to limit the number of interfaces provided. This is because each interface requires certain tolerances to allow for reliable mating and these tolerances tend to increase if the mating is supposed to be repeatable. While it is fairly straightforward to manage these tolerances for low signaling rates, as the signaling rates increase the size of the features that are used to provide a mating connection begin to cause significant problems. For example, when a paddle card mates to a terminal, a contact on the end of the terminal electrically connects to a pad on the paddle card. In order to provide a mechanical connection, the contact needs a curved end (commonly referred to as a stub) to ensure the contact does not stub when engaging the paddle card. The stub changes the mechanical size of the terminal and thus provides an impedance change. Similarly, the pad must be oversized to account for all the position tolerances of the contact so as to ensure the pad on the circuit card makes a reliable electrical connection with the contact. The size of the pad also causes a change in impedance. As a result, the impedance discontinuities in the interfaces can result in significant signal reflection (which causes signal loss). Therefore, as noted above, it is helpful to reduce the number of interfaces in a communication channel that is transmitting signals.

Figure 1:
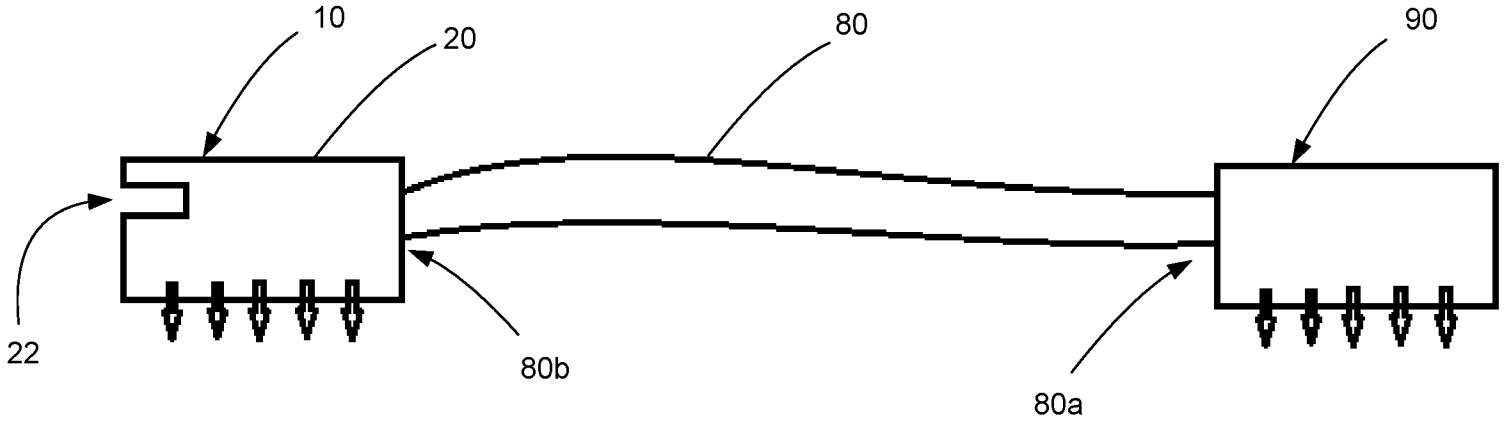
FIG. 1 illustrates a schematic view of an embodiment of connector system.

As can be appreciated from the depicted figures, a connector system can be provided that improves the performance compared to using an FR4 circuit board to transmit signals. This is particularly valuable in systems where there is a substantial distance between a transceiver and a connector that provides a mating interface to the transceiver. As depicted schematically, a first connector 90 and a second connector 10 are electrically connected together via a cable 80. The cable 80 includes a pair of conductors that act as a differential pair and the cable includes a first end 80*a* and a second end 80*b*. The first end 80*a* is terminated to a first signal pair in the first connector 90. The second end is terminated to a second signal pair in the second connector 10. Each of the terminals in the first signal pair has a tail that is configured to be press fit into a circuit board. In a first embodiment, such as is schematically represented in FIG. 1, each of the terminals in the second terminal pair includes a contact supported by the housing 20 and positioned in a card slot 22 that is configured to mate with a mating connector.

It should be noted that both the first connector 90 and the second connector 10 are configured to be attached to the circuit board via a press-fit connection. Thus, for an embodiment where the differential pair of terminals in the second connector 90 have contacts on one end and are terminated to the cable on the other end, the second connector 90 is still expected to have several other terminals with tails that are press-fit into the supporting circuit board (the other terminals can provide, for example, channels for timing and low data rate signaling). The ability for both sides to be attached with a press-fit connection avoids the need to have any type of soldering between the connectors in the connector system and the supporting circuit board (or boards in the case where two boards are positioned adjacent one another) and is expected to improve manufacturability of the corresponding system.

Figure 2:
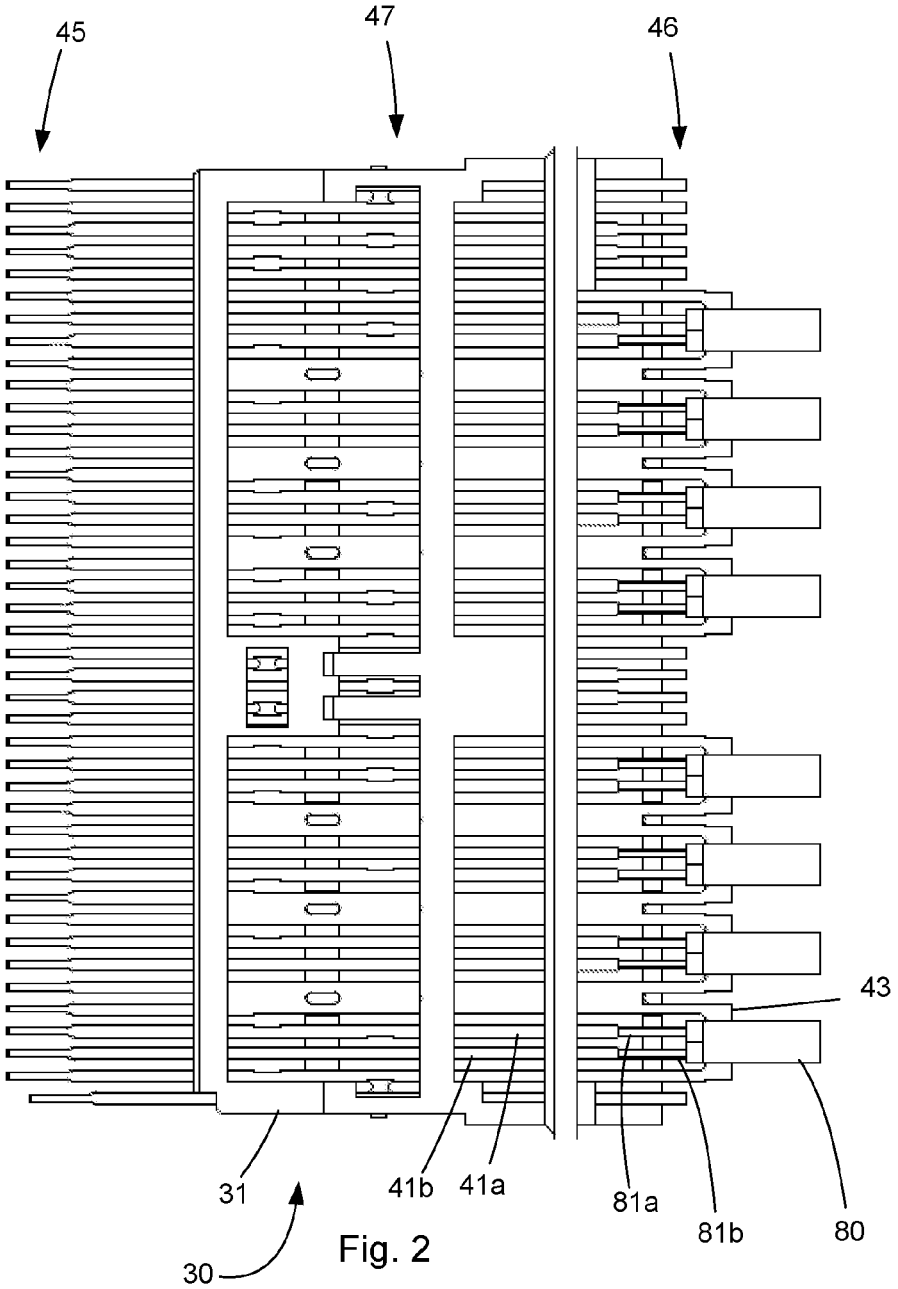
FIG. 2 illustrates a plan view of an embodiment of a wafer.
Figure 3:
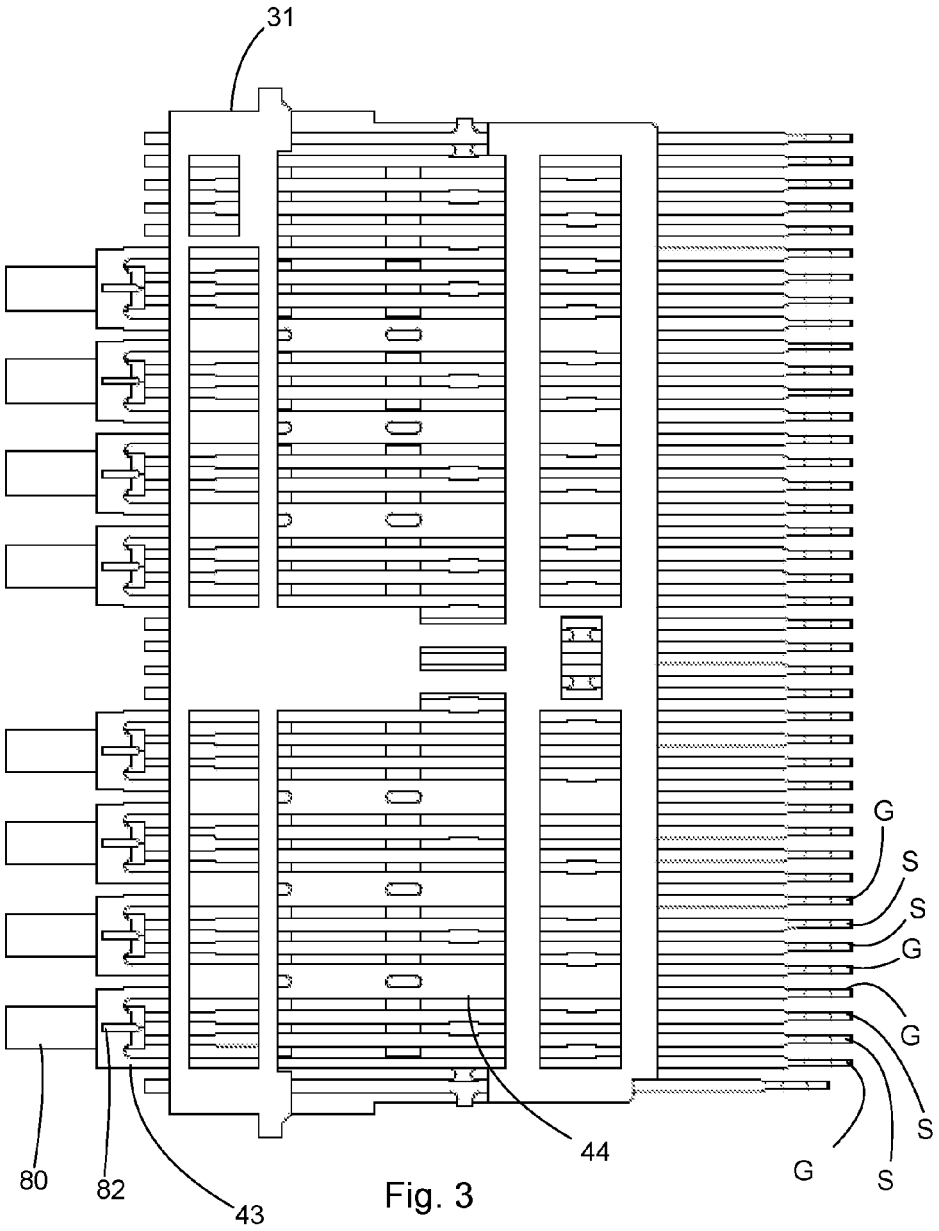
FIG. 3 illustrates a bottom view of the embodiment depicted in FIG. 2.

FIGS. 2 and 3 illustrate an embodiment of a wafer 30. The wafer 30 includes a frame 31 that supports signal terminals 41*a*, 41*b* and ground terminals 43. Each of the terminals includes contacts 45, tails 46 and bodies 47 extending therebetween. As can be appreciated, the ground terminal 43 has a number of terminals commoned together and includes a shielding portion 44 that extends between signal pairs. Thus, the wafer 30 can provide contacts arranged in multiple sets of a ground, signal, signal, ground pattern. Naturally, if there is less need for shielding then the double grounds and shielding portion 44 can be revised so that there is a single ground contact between the pair of signal contacts and the pattern would be a ground, signal, signal pattern.

It should be noted that the connector configuration shown in FIGS. 2 and 3 illustrate embodiments of a high performance connector but do not include tails (thus illustrating a wire-to-paddle card design). The basic construction can be used more flexibly. For example, two wafers as depicted in FIG. 3 (which can be supported by a housing and thus used to provide a connector) can be formed so that the terminals are interweaved with respect to each other. Thus, the features of a wafer as depicted in FIG. 3 could be provided by having two sub-wafers interweaved. Of course, the desirability of weaving two sub-wafers will depend on connector configuration. The wafer 30 of FIG. 2 is likely most suitable for use in a design that has a single card slot and in certain embodiments the connector would be configured to support two wafers 30, one flipped with respect to the other, so that the contacts could be provided on two sides of a card slot.

FIGS. 5-27 illustrate features that can be used an alternative embodiments. It should be noted that while multiple features are disclosed, not all the features need to be included in each embodiment as each feature will have a cost and therefore the performance benefit of that feature versus the cost may, in certain applications, suggest omission of the feature.

A connector system 110 includes a first connector 110*a* with a frame 189 and a second connector 110*b* coupled by a cable 180. The figures illustrates a simplified model in that multiple cables 180 are illustrated being terminated to the same terminals. In addition, certain cables 180 are depicted as being truncated and are not shown as being terminated. In practice, each cable could be terminated in a comparable manner and each cable would be terminated to a different set of terminals. Thus, in a non-simplified illustration connector 110*a* would have a frame 189 that supported additional terminals. However, for purposes of illustrate and depiction, it is simpler to use less examples with the understanding that the features can be repeated as needed, depending on the number of cables 180 that are used.

As depicted, connector 110*b* is supported by circuit board 112 while connector 110*a* is supported by circuit board 114. In many applications a single circuit board can be used to support both connectors 110*a*, 110*b*. As can be appreciated, for larger circuit boards, the cable(s) 180 can be configured to be longer (such as greater than 15 cm) so that one connector is mounted a significant distance apart from the other connector.

Connector 110*b* includes a housing 120 that includes a first card slot 122*a* and as depicted, also includes a second card slot 122*b*. Each of the card slots include a first side 123*a* and a second side 123*b*. It should be noted that the depicted design thus allows for a stacked connector (the two card slots are spaced apart vertically, thus the connector is "stacked") but is equally applicable to an application of a connector where only one card slot is desired. Therefore the depicted illustrates are exemplary but a connector with only one card slot is contemplated and would be a simple modification of the depicted embodiments. Paddle cards 105 can be inserted into the card slots so as to make electrical connection. The paddle cards 105 will typically be part of a mating connector system (not shown for purposes of clarity).

Each card slot includes at least one row 141 of contacts 145. It is common, similar to what is depicted, to have two rows of contacts in each card slot with one row of contacts on the first side 123*a* facing in a first direction and another row of contacts on the second side 123*b* facing an opposite direction. Thus, for example, cable 180*a* could be used to electrically connect to terminals on the first side 123*a* (e.g., in a top row) of the card slot while cable 180*b* could be used to electrically connector to terminals on the second side 123*b* (e.g., on a bottom row) of the card slot.

The housing 120 supports ground wafers 150, which each support a ground terminal 151 that can include legs 152. The ground terminal 151 can be configured with press-fit tails. The housing can also support low-speed signal wafers 170, which can be formed in a conventional manner with terminals that include contacts 145 and tails that are configured to be press fit into a circuit board. As such construction is well known, nothing further need be said about the low-speed signal terminals.

As depicted, a signal module 160 is positioned between two ground wafers 150. A U-shield 158 is positioned between the ground wafers 150 and can provide shielding to signal channels on opposite sides of the card slot while electrically connecting ground terminals 151 in the ground wafers 150 on opposite sides of the U-shield 158. The U-shield also supports cable support 178, which along with cable support 177, helps ensure the cable 180 is secured in position and works to minimize strain on terminations between the cable and the terminals in the connectors. The cable support 177, which is optional, can be sandwiched between two ground wafers 150 and can include a projection that fits in a corresponding recess 150*b* that is provided on both sides of insulative web 150*a* of the ground wafer 150 so that it is secured to the ground wafers 150. The inclusion of the optional cable support 177 helps provide additional strain relief for the cable 180 and increases the robustness of the connector system but in certain applications may not be desired or beneficial. Of course, in an embodiment the cable support 178 could be omitted and just cable support 177 could be provided. While neither cable support is required, in practice it is expected that omitting both will make the connector system more susceptible to damage during installation and thus most applications will benefit from the inclusion of one or both cable supports.

As noted above, the U-shield 158 can be used to common terminals 151 in adjacent ground wafers 150. In an embodiment, the U-shield can include projections 159*a*-159*f* that are configured to engage fingers 153 in aperture 154 (typically with an interference fit). The depicted U-shield 158 has the projections 159*a*-159*f* configured such that one side has a projection in a forward position and the opposite side has a projection in a rearward position. The alternating positions allow the projections to overlap and engage adjacent fingers 153 in an aperture 154 of the shield wall 152 when the U-shield 158 is installed. While the depicted U-shield 158 has three projections on each side, in embodiment some other number of projections could be provided.

To improve electrical performance, the U-shield 158 can include a solder connector 158*a* to a shield provided on the cable 180. The U-shield also can provide an electrical termination for the ground wire 182 with termination groove 158*b*. As the U-shield 158 can be electrically connected to ground terminals 151 on both sides of the two signal terminals, the additional connection further improves the electrical performance of the connector system by reducing reflections that might otherwise exist due to the transition between the cable and terminals 164.

The cable 180 includes signal conductors 181*a*, 181*b* that are electrically connected to terminals 164 so as to provide signal terminals S1 and S2 (which can form a differential pair that are broad-side coupled). In an embodiment, the terminals 164 include terminal notches 167 and the signal conductors 181*a*, 181*b* are positioned in the terminal notches 167 and can be secured there with solder or conductive adhesive or the like.

The terminals 164, which include a body 166, are positioned in the signal module 160, which include a sub-wafer 161*a* and a sub-wafer 161*b* pressed against each other. Each sub-wafer can support multiple terminals 164 and in the depicted embodiment supports two terminals 164 with each terminal in the flipped orientation compared to the other. It should be noted that while the depicted embodiment uses two of the same terminals 164. The signal module 160 is therefore configured to provide contacts 145*a* and 145*b* on one side of a card slot and contacts 145*c* and 145*d* on the other side. The signal module 160 can be configured with projections 169*a*, 169*b* that engage the ground wafers 150 and helps control the position of signal module 160 relative to the ground wafers 150. In an embodiment the sub-wafers can formed by stitching terminals in a formed insulative structure. Alternative, the sub-wafer can be formed using an insert-molding operation.

The first connector 110*a*, which provides terminal for the cable 180, includes a housing 190 that supports terminals and is positioned in the frame 189 (which as noted above, can be sized to support a larger number of housings 190). The housing 190 includes a wall 191 that supports ground terminal 194 and that supports brick 191*a* and 191*b*. The brick 191*a* supports signal terminal 193*a* and brick 191*b* supports signal terminal 193*b*. The signal conductors 181*a*, 181*b* are electrically connected to signal terminals 193*a*, 193*b*, respectively, and the ground wire 182 is electrically connected to ground terminal 194. In an embodiment the conductors can be soldered to the terminals and each terminal can include a press-fit tail (which is omitted for purposes of clarity but can be any desirable press-fit style tail). To help secure the bricks 191*a*, 191*b* to the wall 191, a securing member 192 can be added. The securing member 192 can be provided with a potting material in a known manner.

Figure 4:
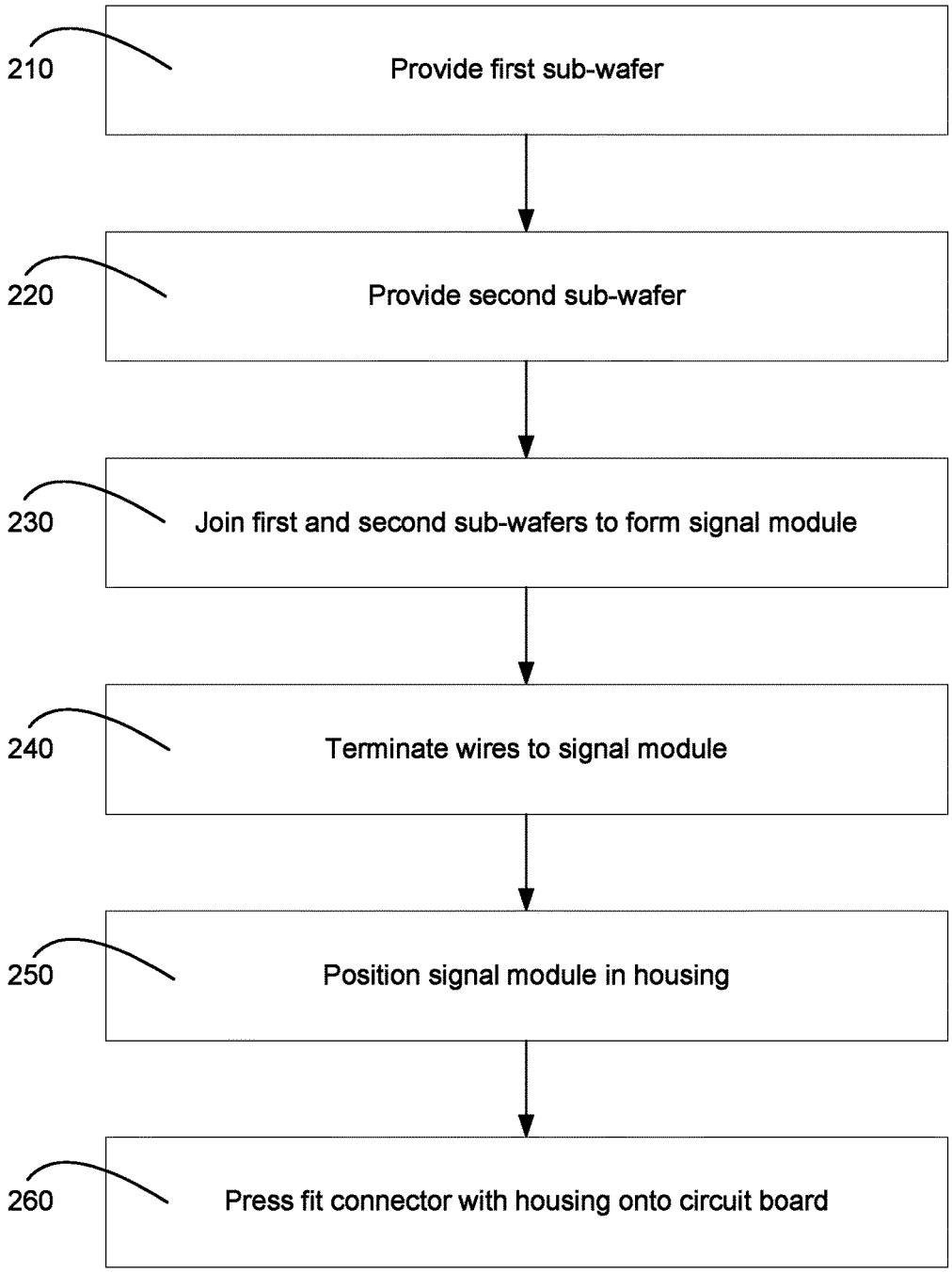
FIG. 4 illustrates a method of providing a connector on a circuit board.
Figure 5:
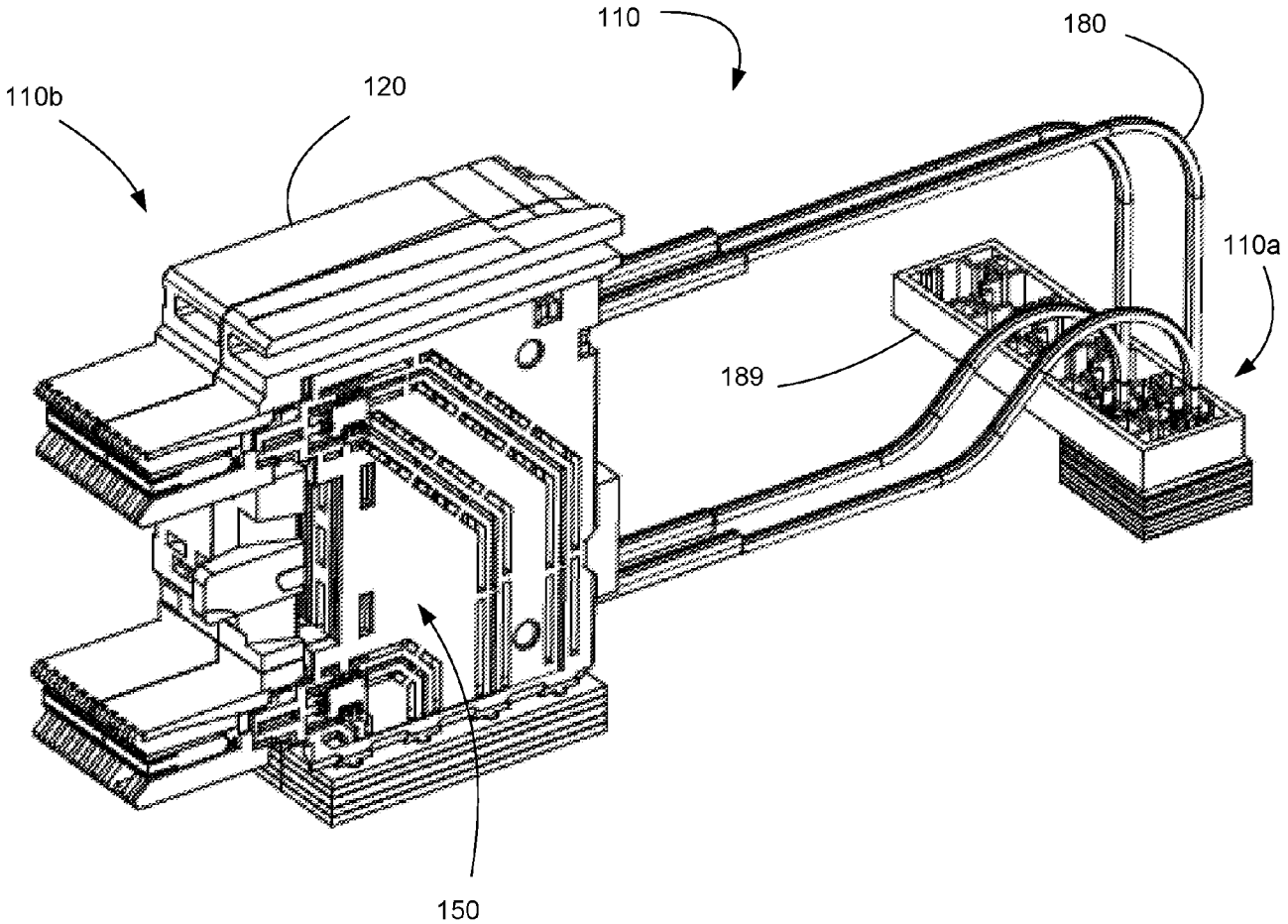
FIG. 5 illustrates a perspective view of an embodiment of a simplified version of connector system.
Figure 6:
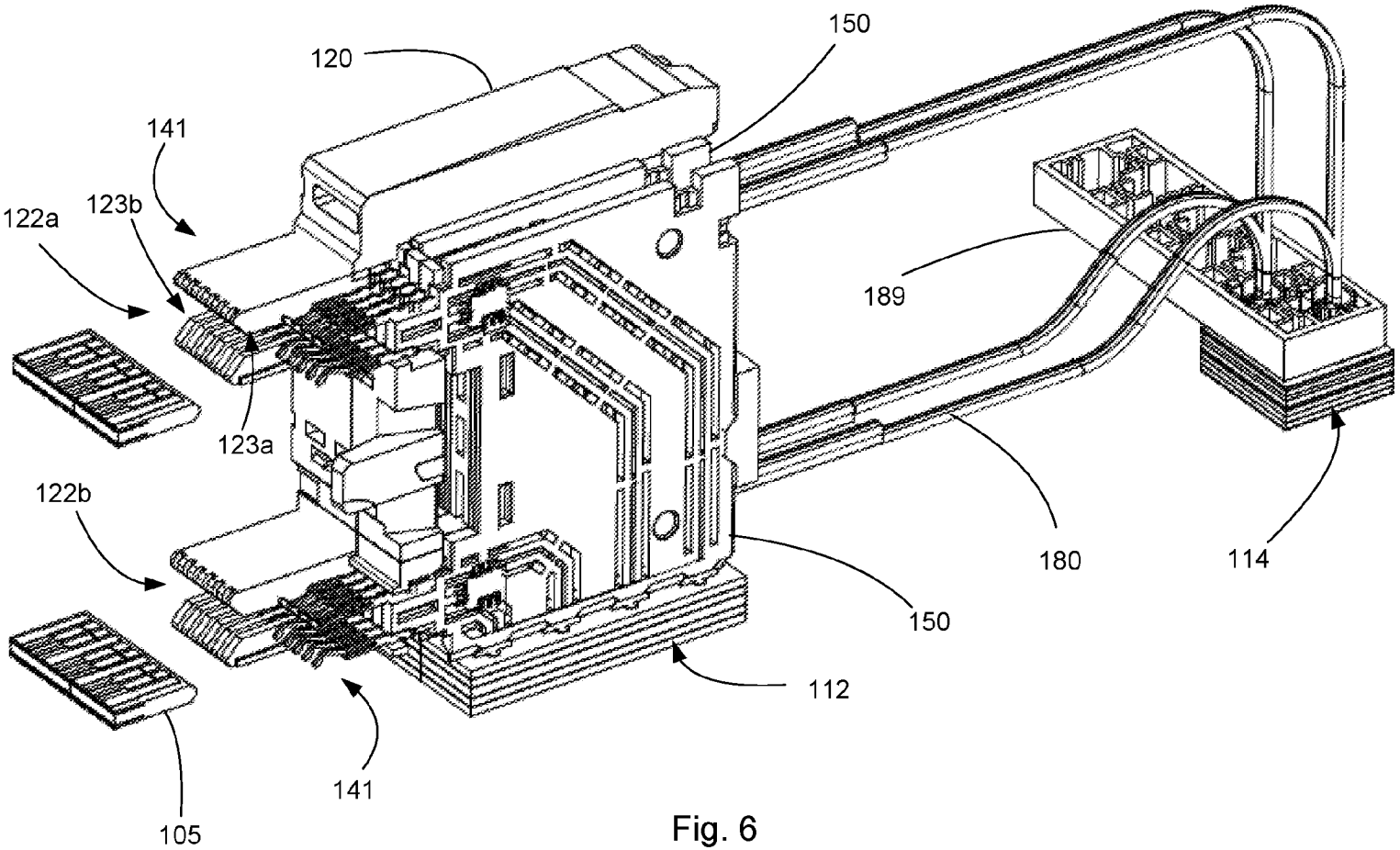
FIG. 6 illustrates a perspective view of a further simplified depiction of the embodiment depicted in FIG. 5.
Figure 7:
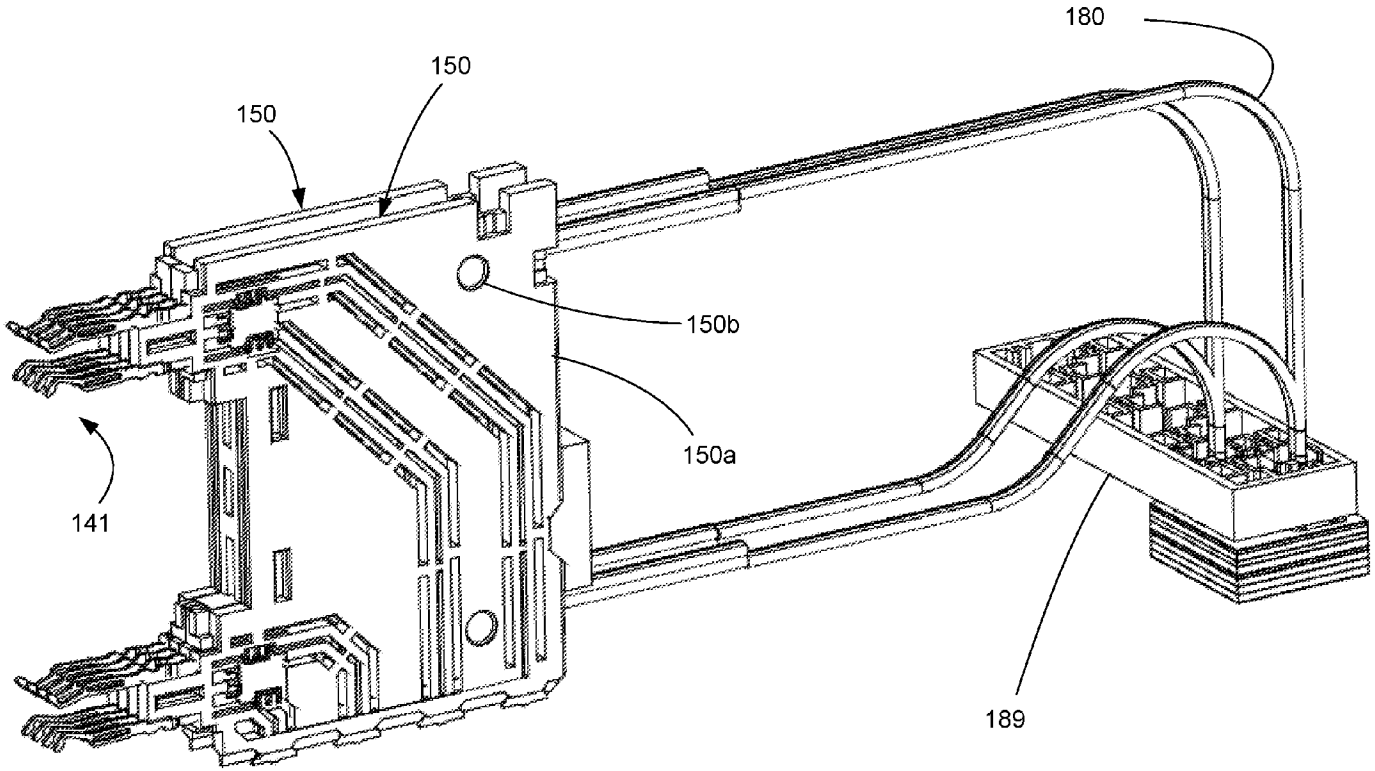
FIG. 7 illustrates a simplified perspective view of the embodiment depicted in FIG. 5.
Figure 8:
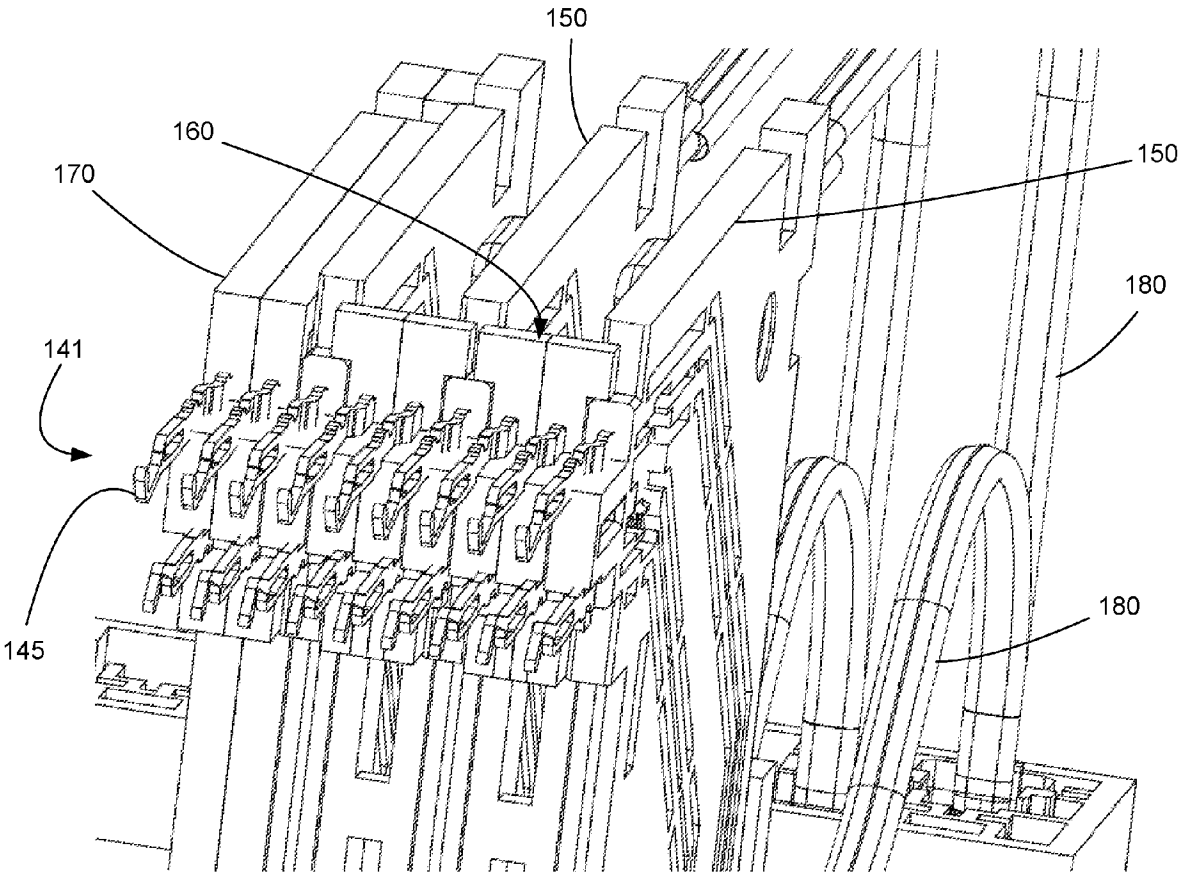
FIG. 8 illustrates an enlarged perspective view of the embodiment depicted in FIG. 5 with the housing removed.
Figure 9:
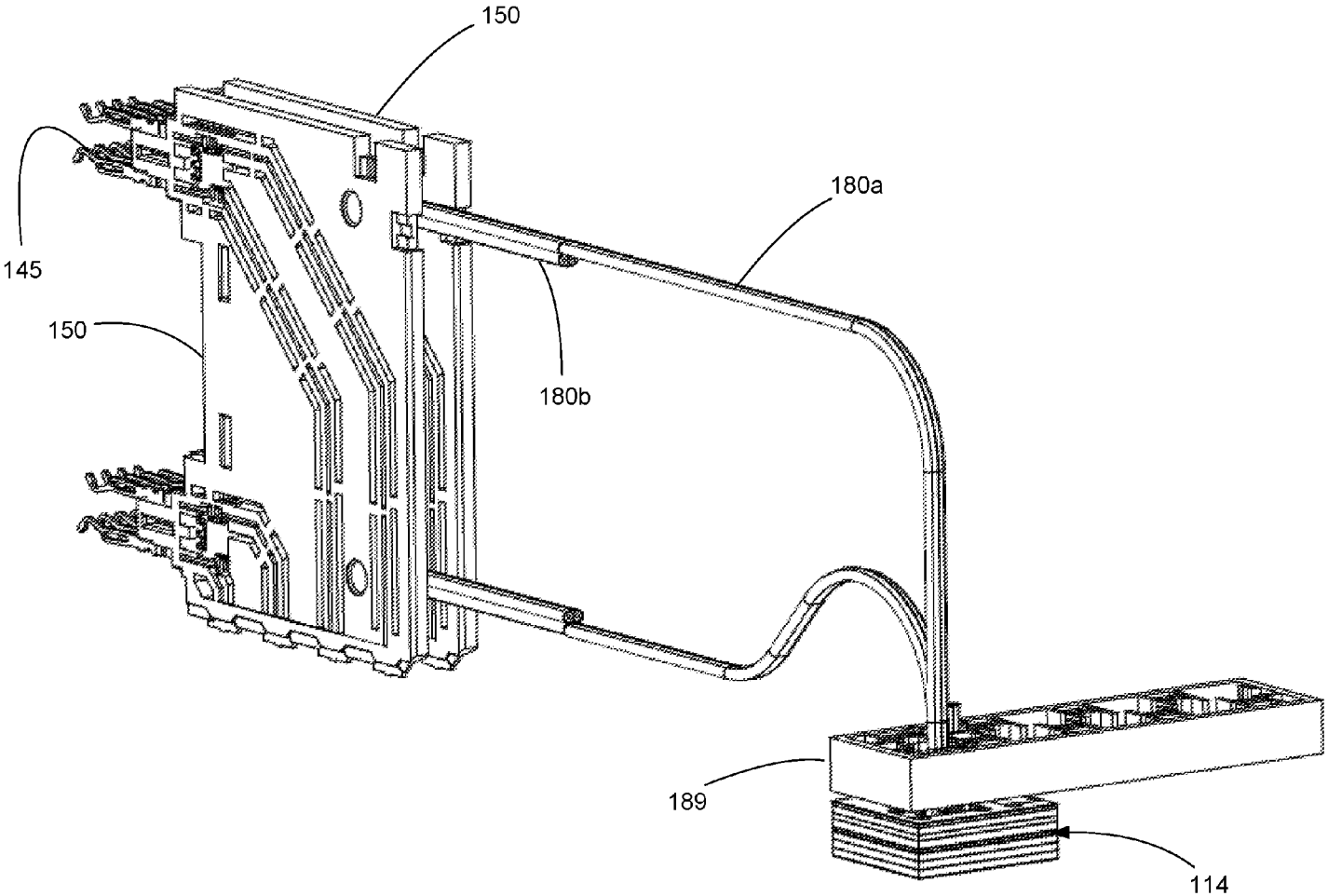
FIG. 9 illustrates another perspective view of the embodiment depicted in FIG. 7.
Figure 10:
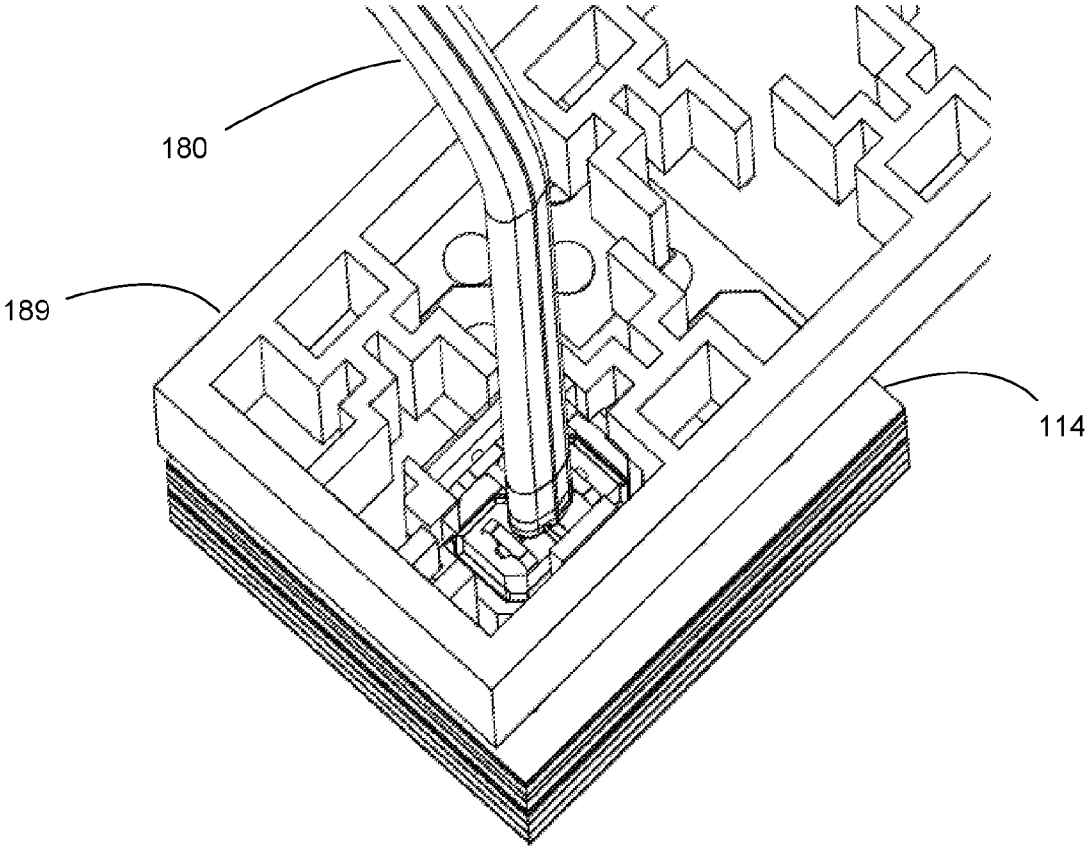
FIG. 10 illustrates a simplified perspective view of one of the connectors depicted in FIG. 5.
Figure 11:
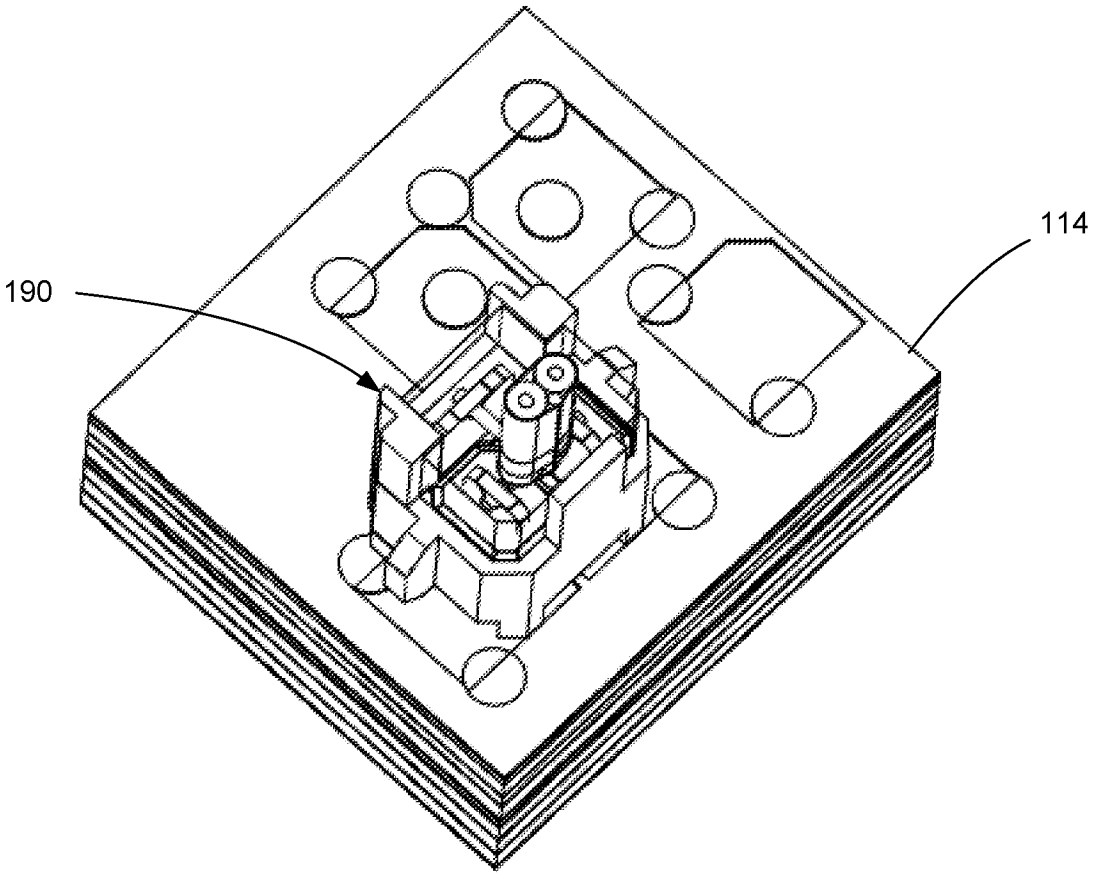
FIG. 11 illustrates a further simplified perspective view of the embodiment depicted in FIG. 10.
Figure 12:
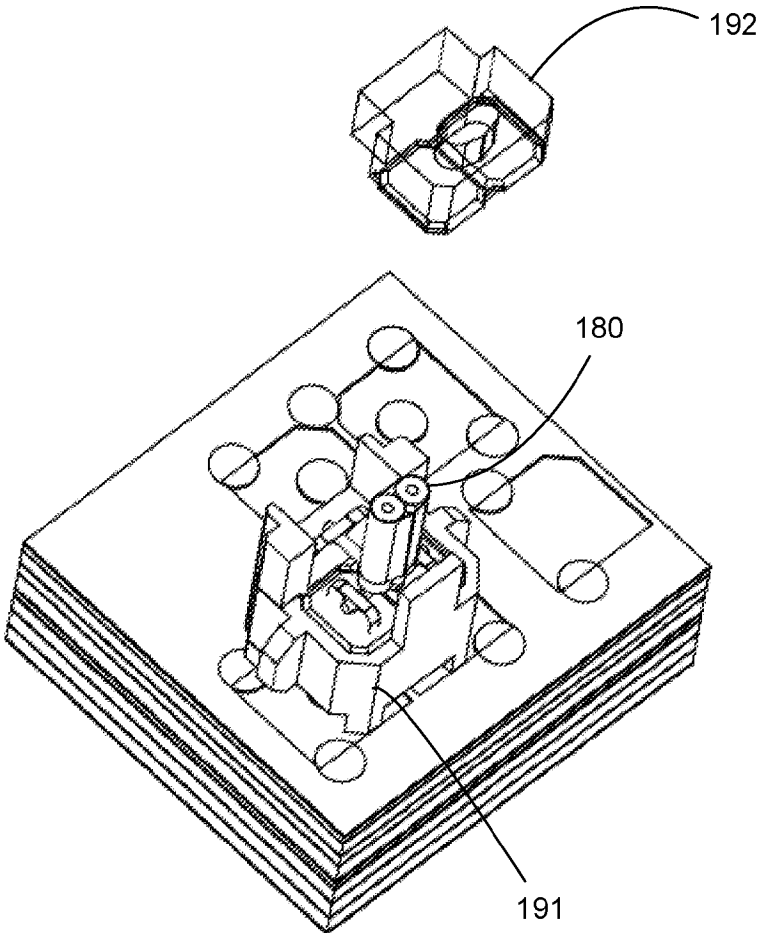
FIG. 12 illustrates a partially exploded perspective view of the embodiment depicted in FIG. 11.
Figure 13:
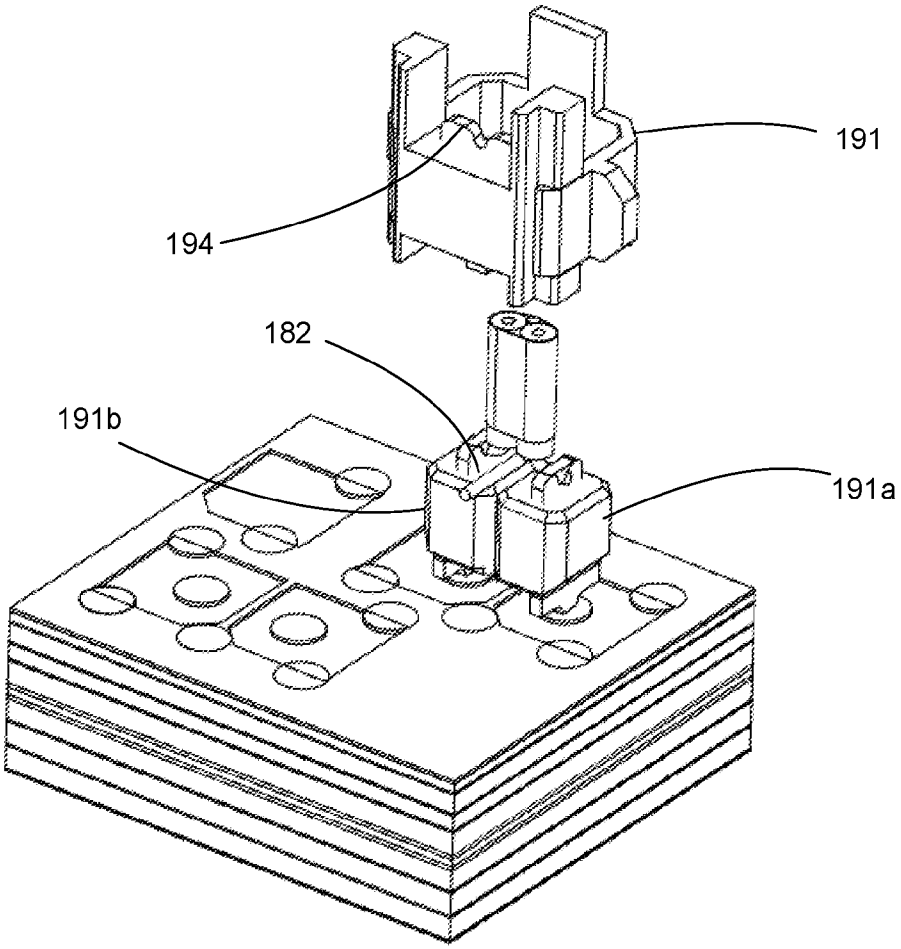
FIG. 13 illustrates a partially exploded simplified perspective view of the embodiment depicted in FIG. 12.
Figure 14:
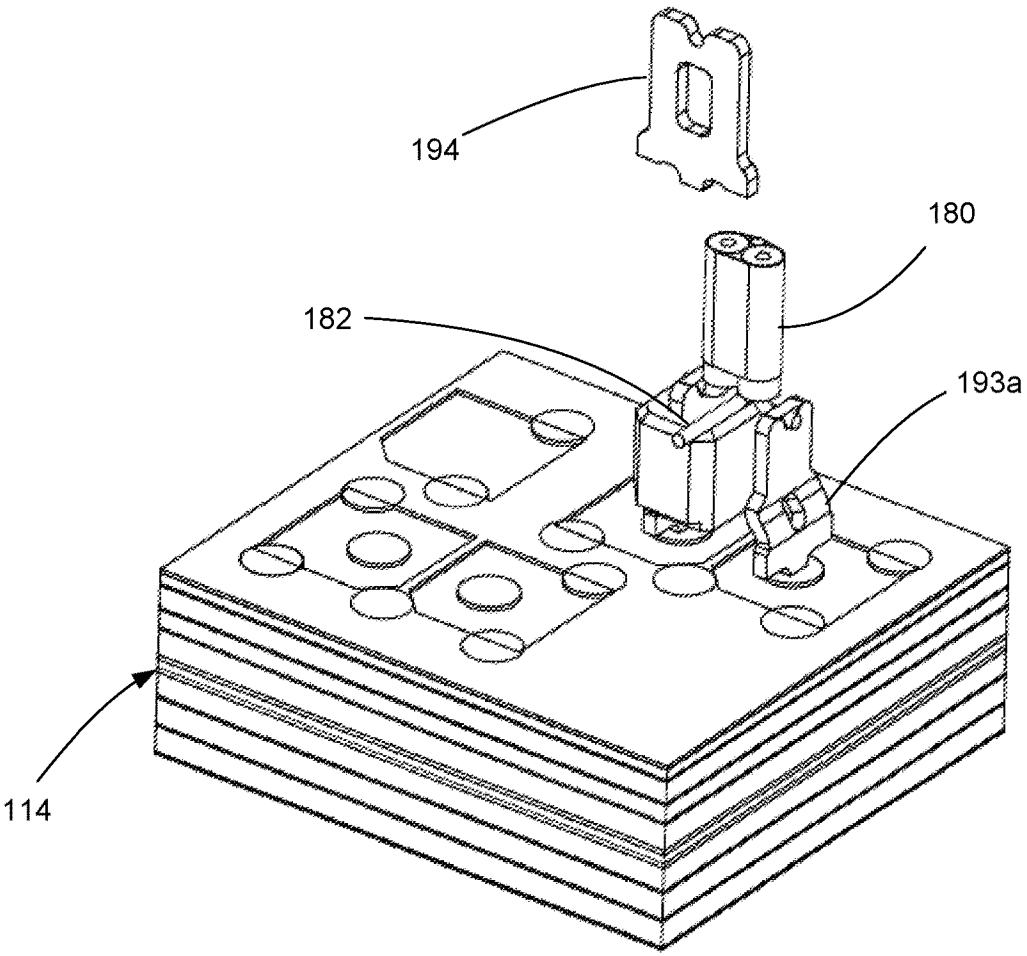
FIG. 14 illustrates a simplified, partially exploded perspective view of the embodiment depicted in FIG. 13.
Figure 15:
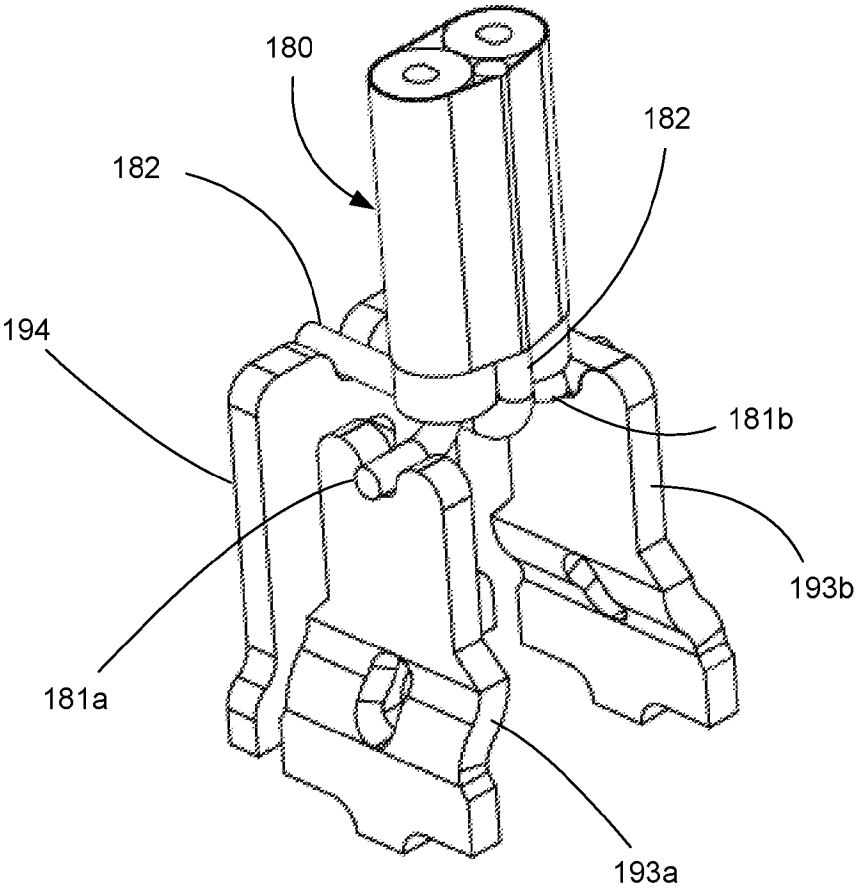
FIG. 15 illustrates a simplified perspective view of the embodiment depicted in FIG. 11 with the housing omitted.
Figure 16:
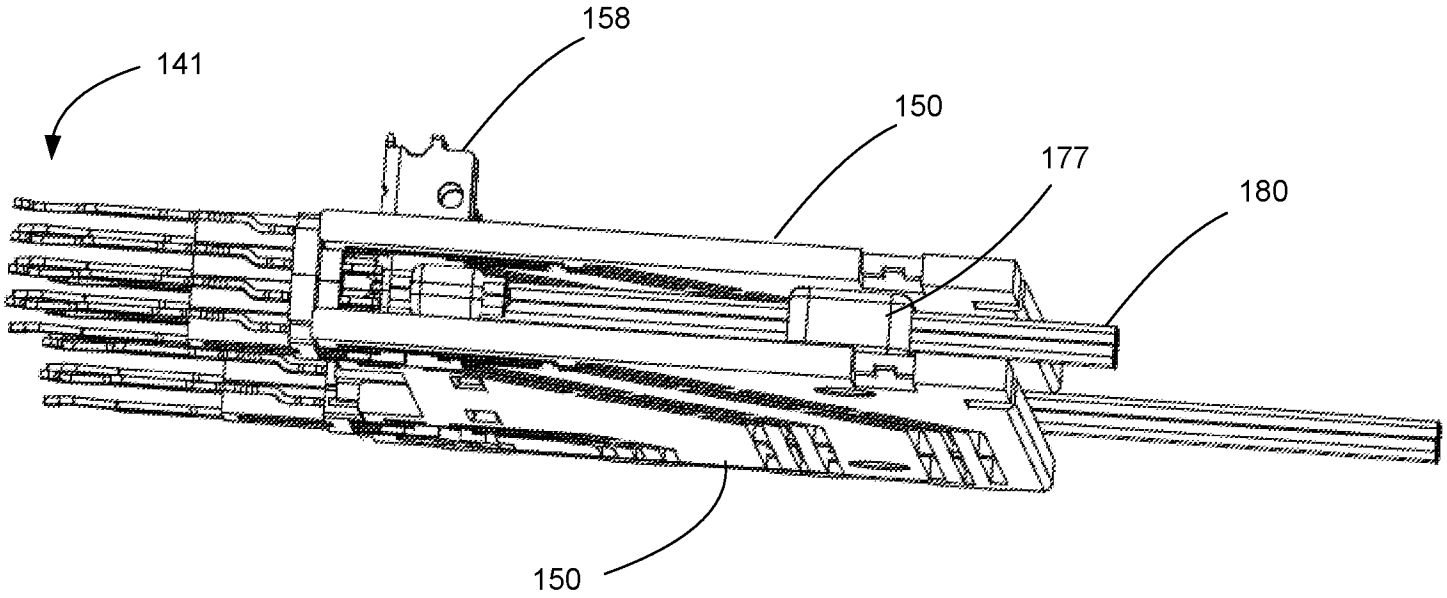
FIG. 16 illustrates a perspective view of an embodiment of a signal module positioned between two ground wafers.
Figure 17:
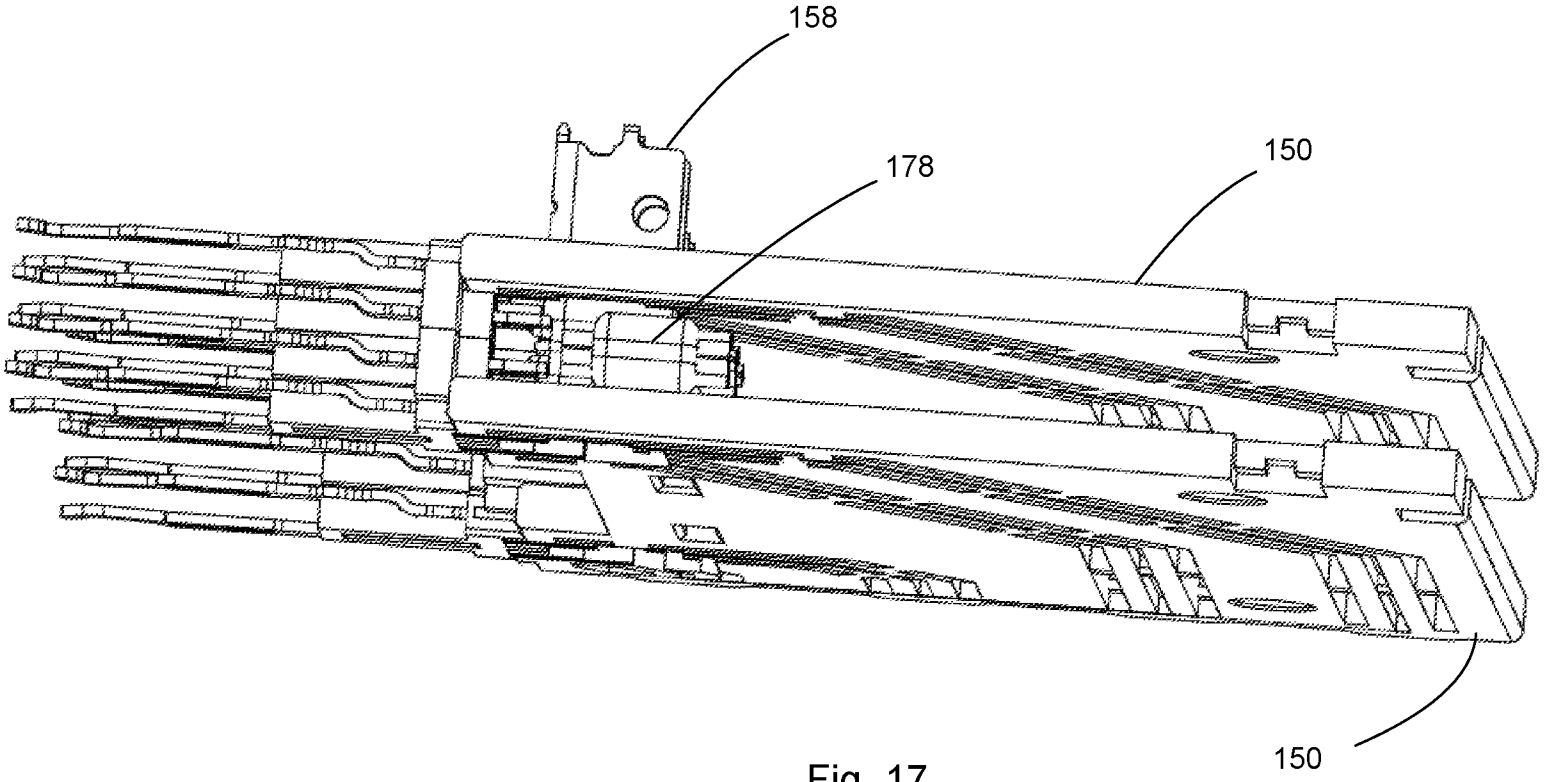
FIG. 17 illustrates a simplified perspective view of the embodiment depicted in FIG. 16.
Figure 18:
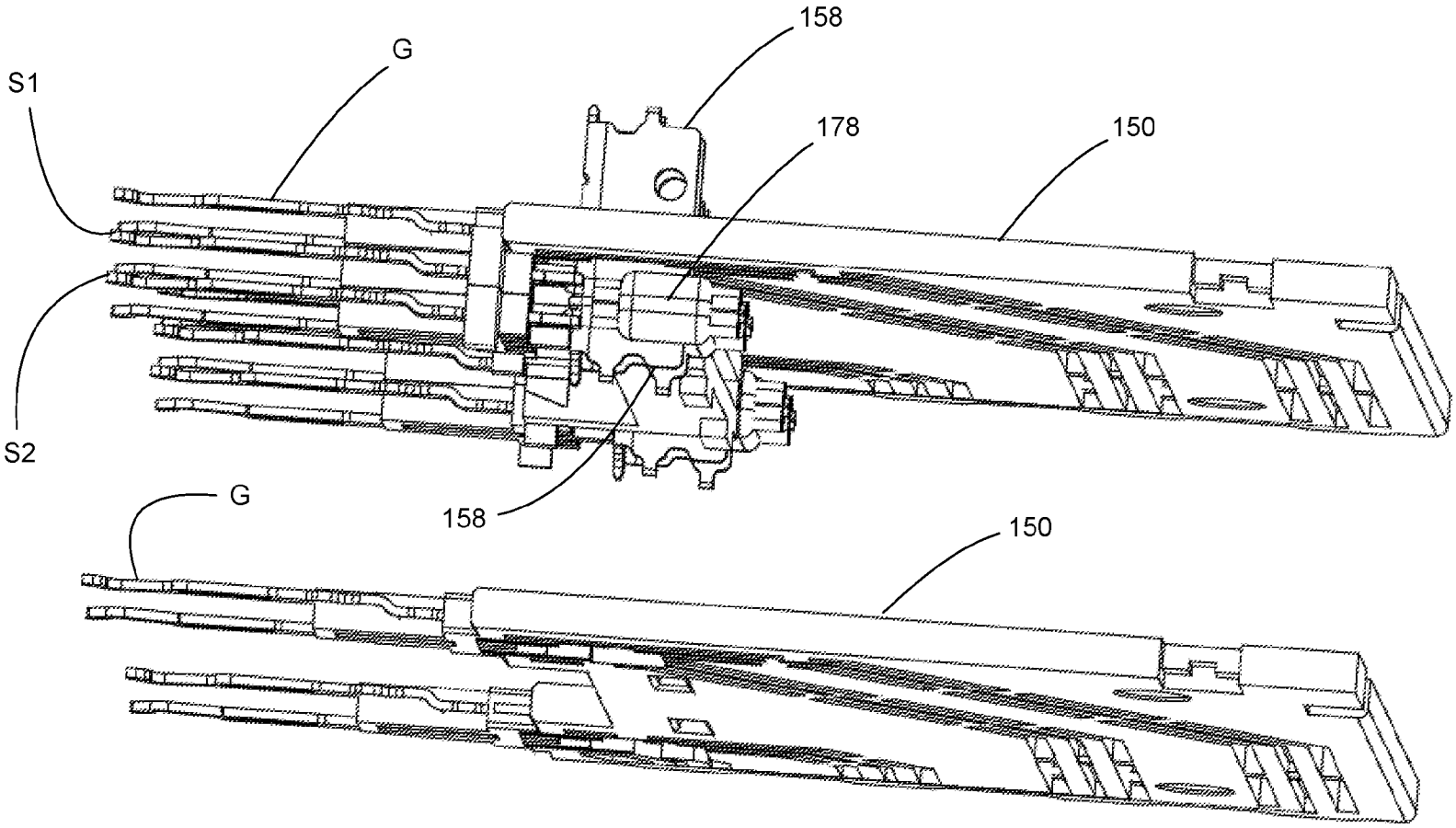
FIG. 18 illustrates a partially exploded perspective view of the embodiment depicted in FIG. 17.
Figure 19:
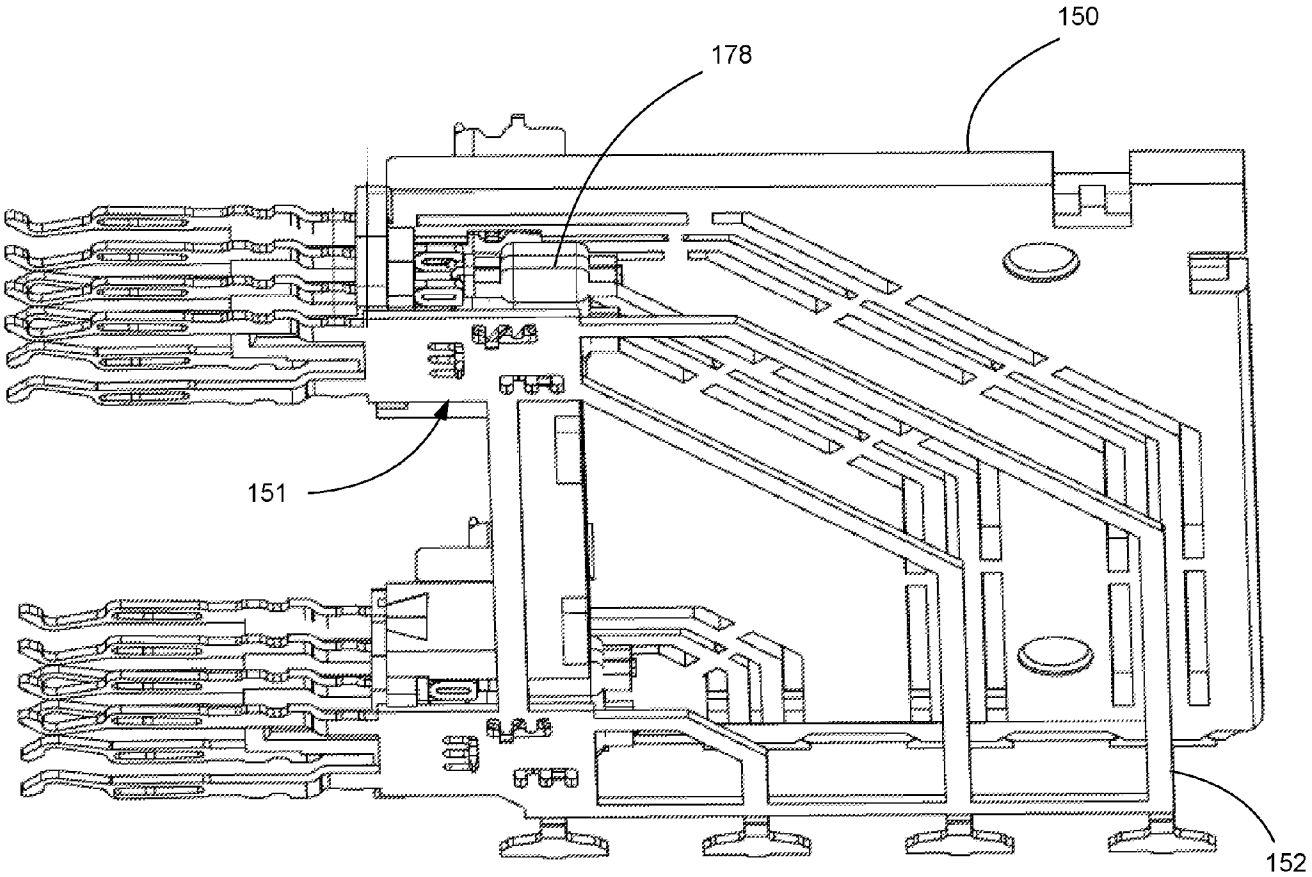
FIG. 19 illustrates a partial perspective view of the embodiment depicted in FIG. 17 with an insulative web of a ground wafer removed.
Figure 20:
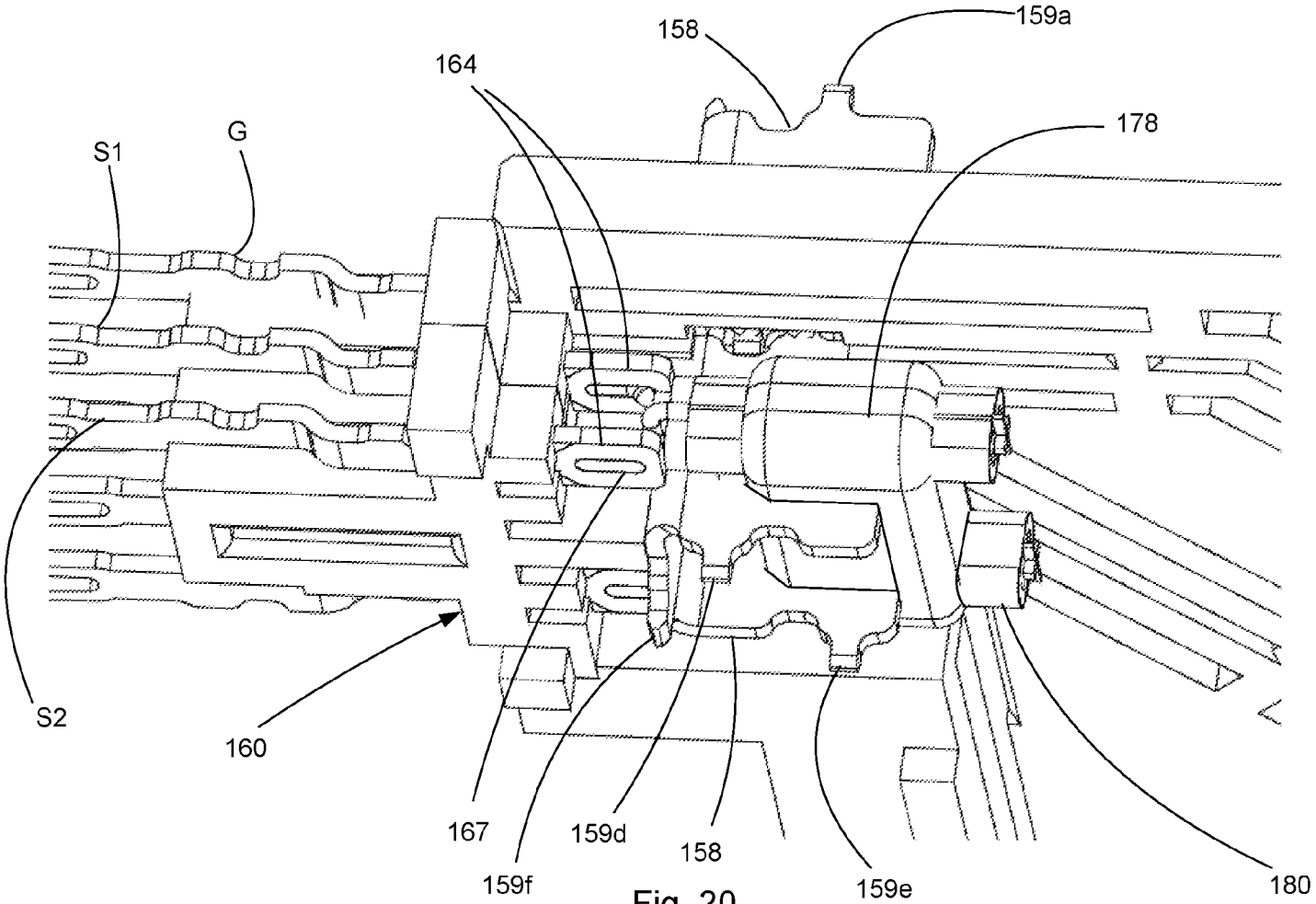
FIG. 20 illustrates a simplified perspective view of the embodiment depicted in FIG. 17 with one of the ground wafers removed.
Figure 21:
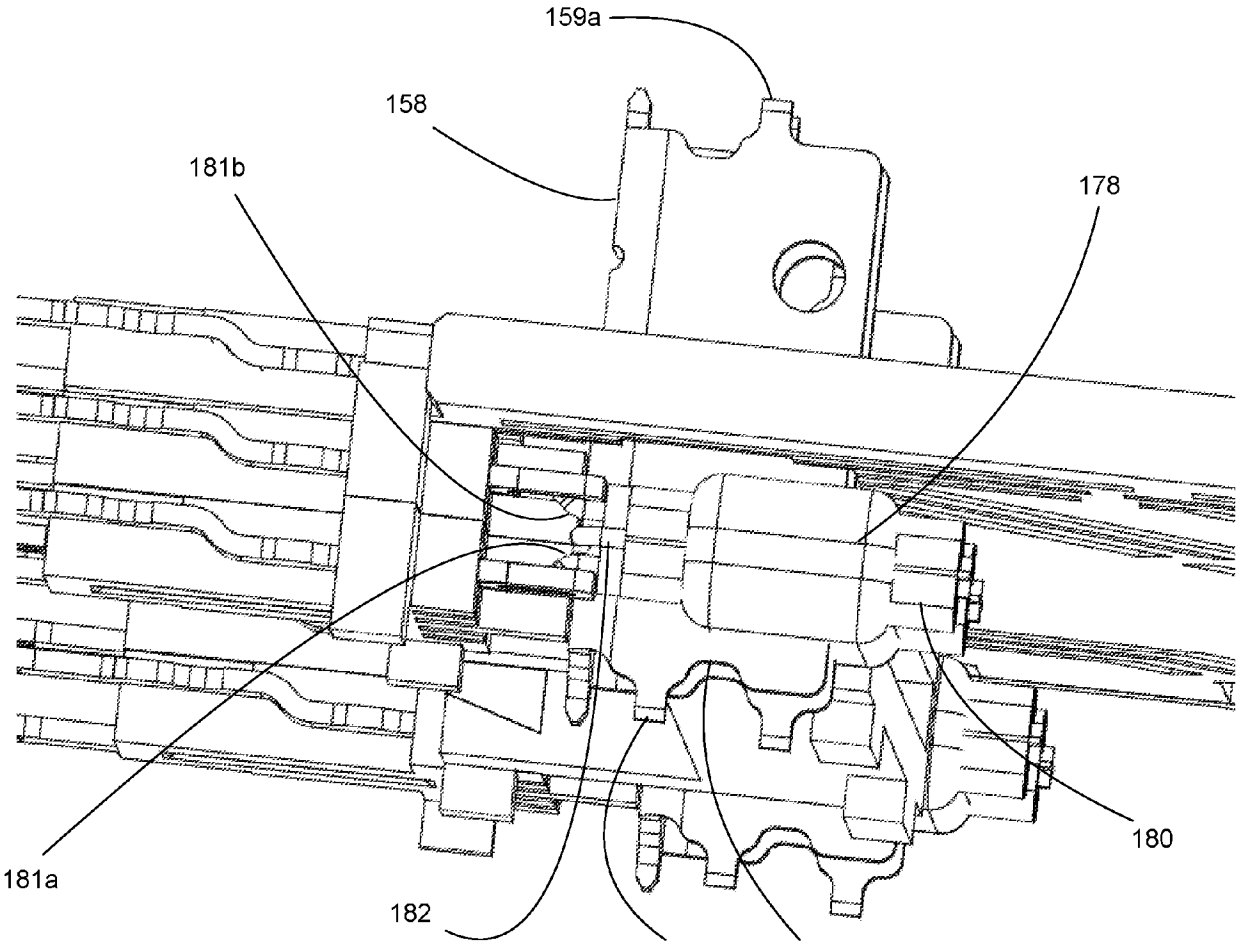
FIG. 21 illustrates an enlarged different perspective view of the embodiment depicted in FIG. 20.
Figure 22:
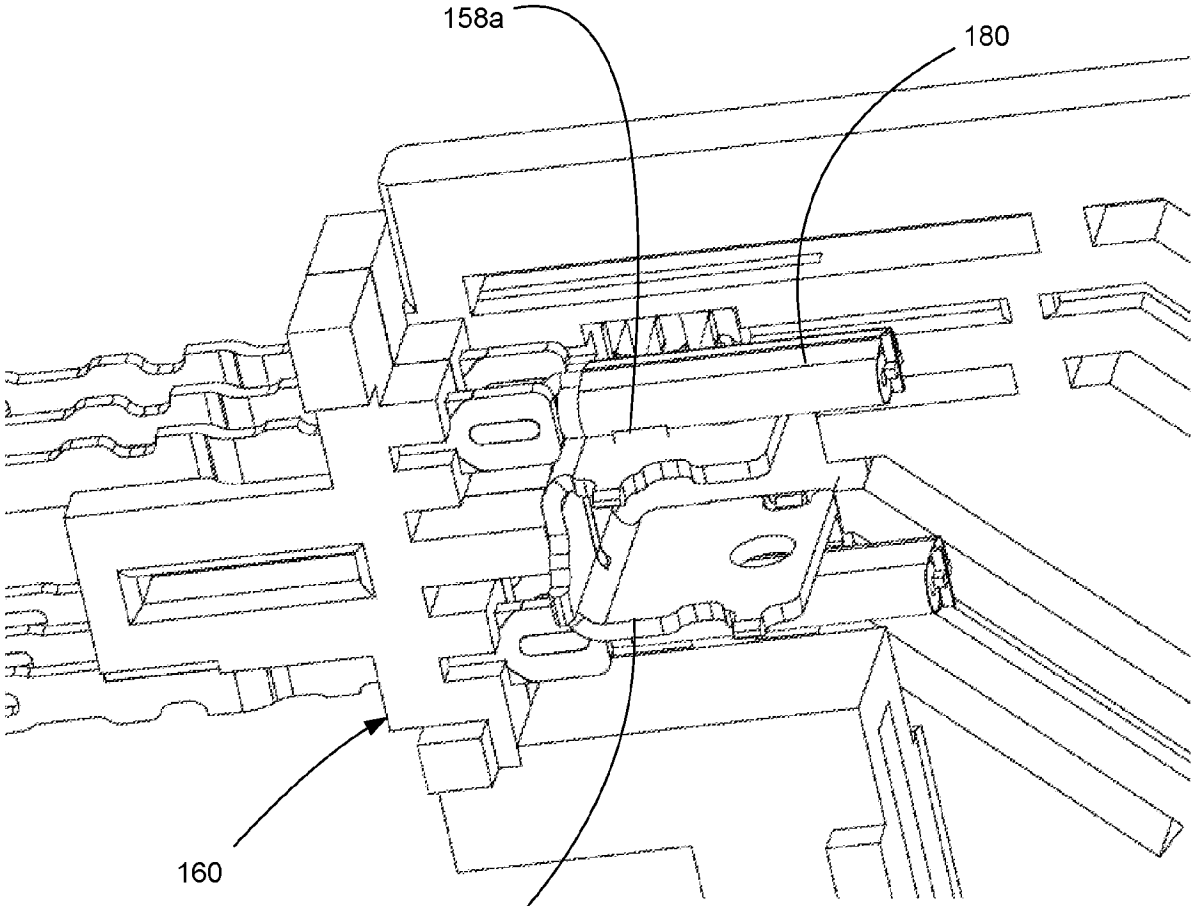
FIG. 22 illustrates a simplified perspective view of the embodiment depicted in FIG. 21.
Figure 23:
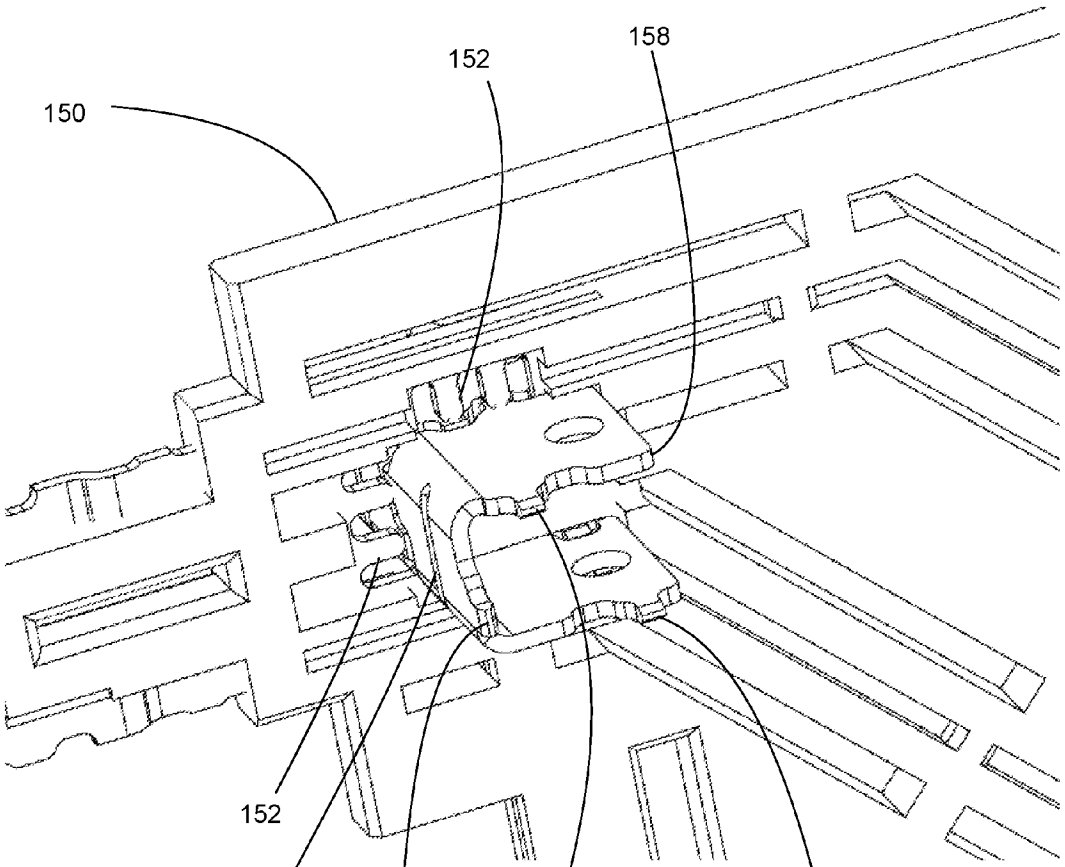
FIG. 23 illustrates a simplified enlarged perspective view of an embodiment of a ground wafer and a U-shield.
Figure 24:
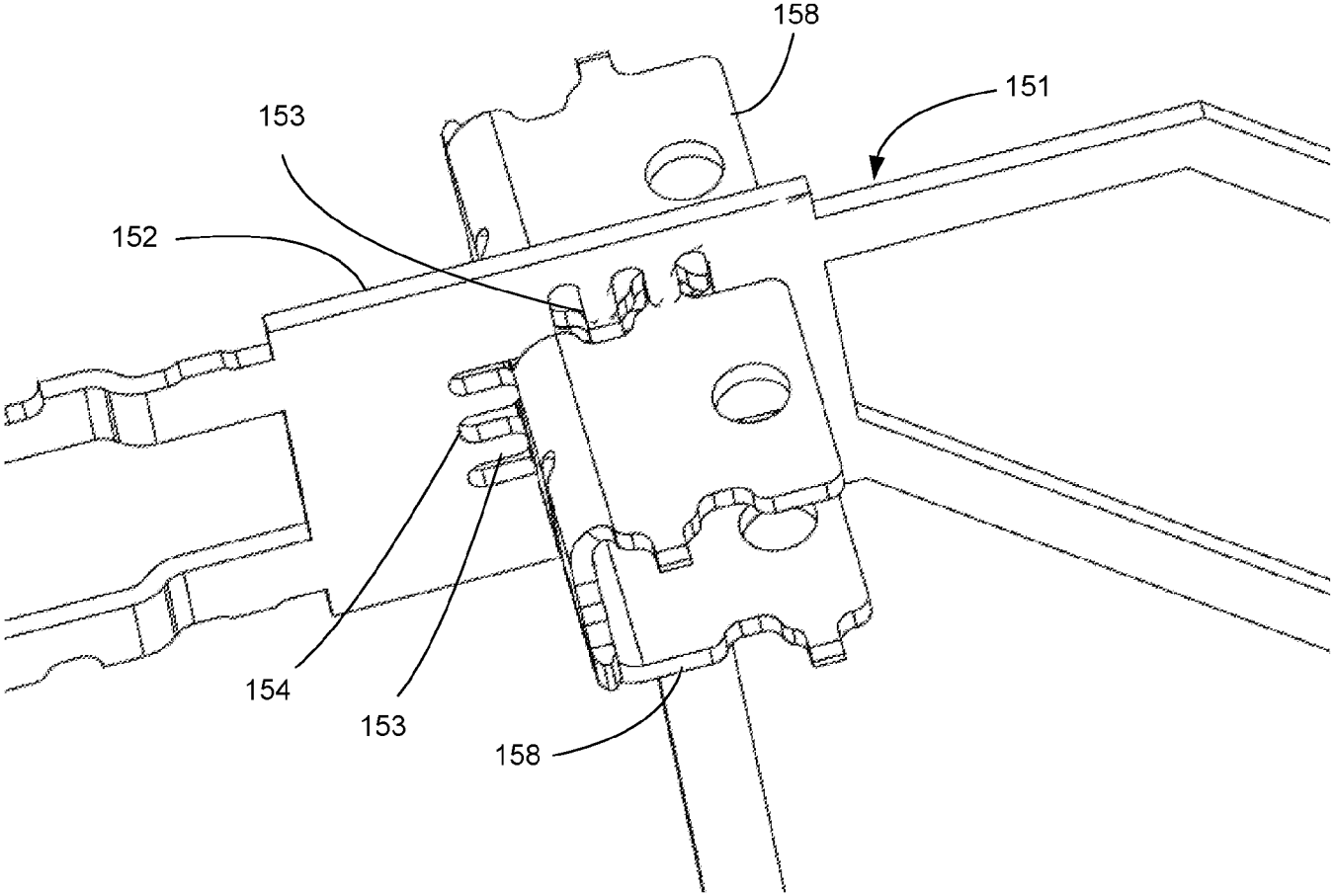
FIG. 24 illustrates a simplified view of the embodiment depicted in FIG. 23 with an insulative web of the ground wafer removed.
Figure 25:
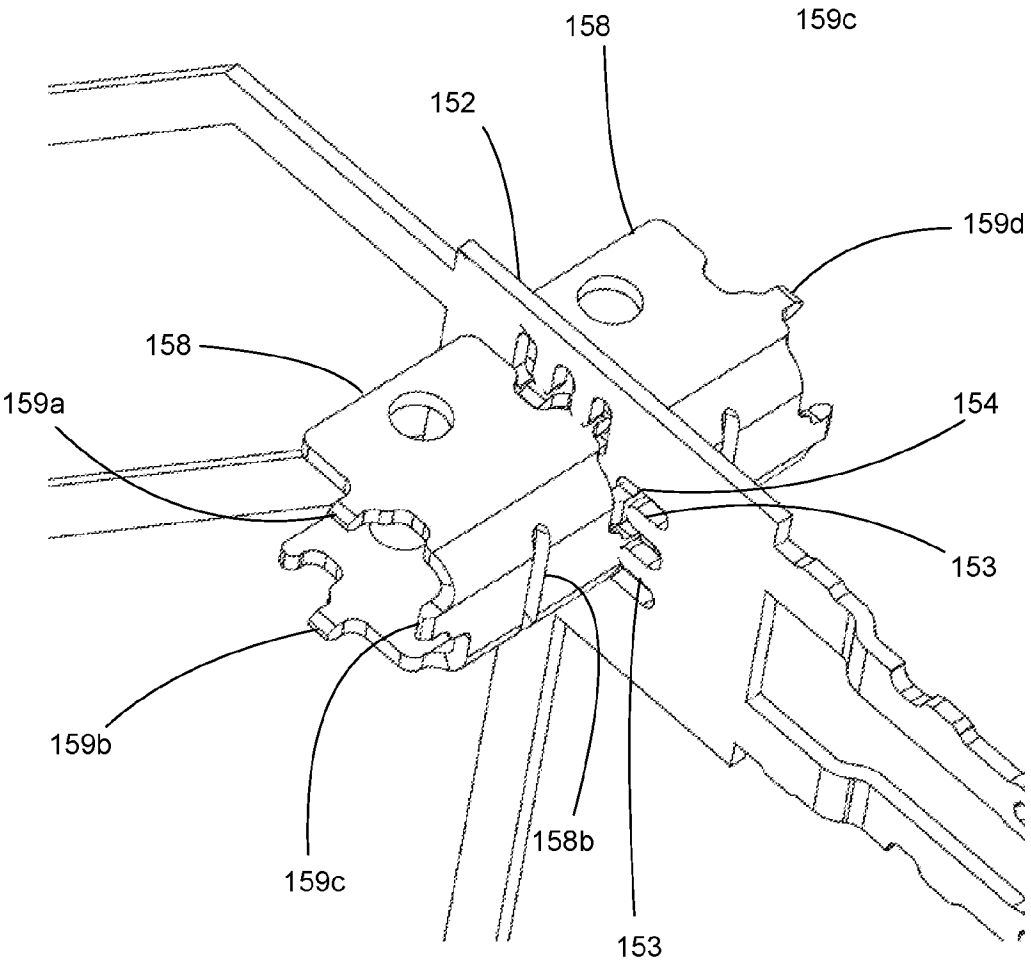
FIG. 25 illustrates another perspective view of the embodiment depicted in FIG. 24.
Figure 26:
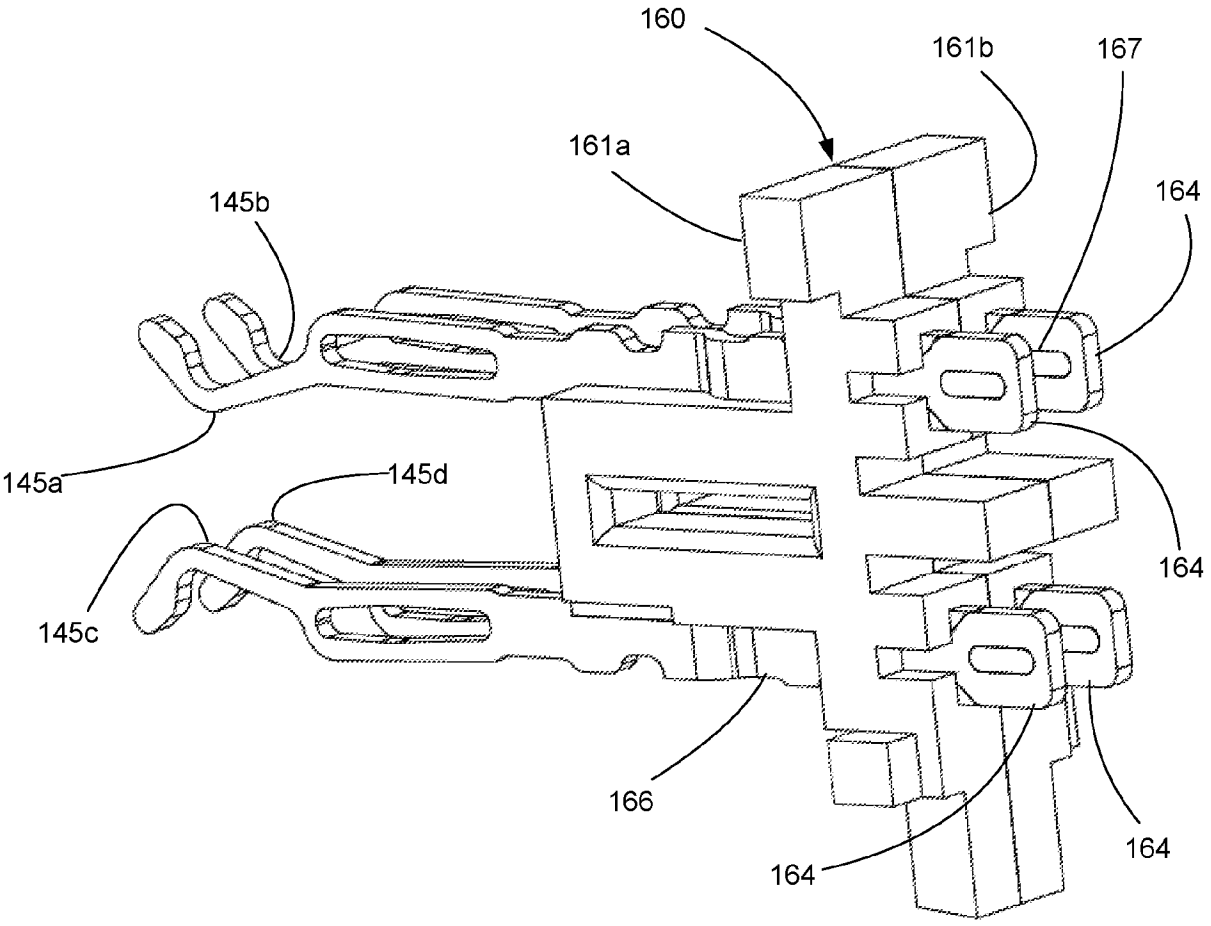
FIG. 26 illustrates a perspective view of an embodiment of a signal module.
Figure 27:
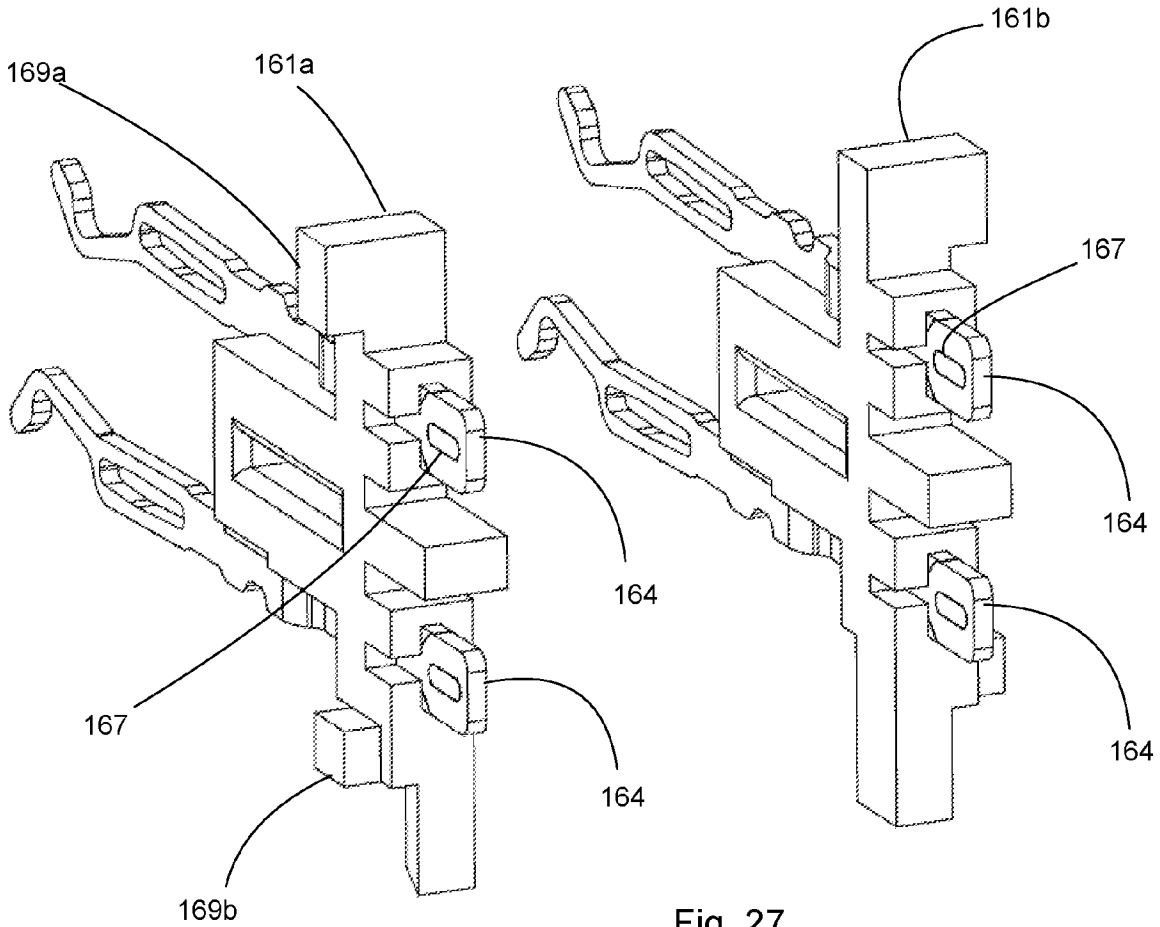
FIG. 27 illustrates a partially exploded perspective view of the embodiment depicted in FIG. 26.

FIG. 4 illustrates a method of providing a connector on a circuit board. First in step 210 a sub-wafer is formed. The sub-wafer can be as depicted herein or could be larger and includes one or more signal terminals. Next in step 220 a second sub-wafer is formed. The second sub-wafer typically will be sized similarly as the first sub-wafer and can include the same number of signal terminals. In step 230, the first and second sub-wafers are joined together to form a signal module. The signal module can consist entirely of signal terminals and if so, typically will be about the same width as two conventional wafers. In step 240, conductors from a cable are terminated to the signal terminals in the signal module. This termination can be done via a solder operation or with the use of conductive epoxy or through a mechanical attachment. In step 250, the signal module with the connected cable is positioned in a housing. The positioning can include arranging a ground wafer on both sides of the signal module. As can be appreciated, multiple signal modules can be positioned in a housing, thus steps 210-250 can be repeated as desired. Finally, when the connector is ready to be mounted, the connector is pressed onto a circuit board. As can be appreciated, as the signal module may not include any terminals with tails that are configured to be attached to a circuit board, the connector will typically include other wafers with press-fit tails (such as the ground wafers and/or low-speed signal wafers).

As can be appreciated, in the above embodiments the number of interfaces can be limited to four interfaces for the high data rate signal channels (contact of first terminal, first cable termination, second cable termination, and press-fit tail to circuit board). In addition, this allows the connector assembly to be formed and then placed onto a circuit board after the various features of the circuit board are soldered in place. This allows for a reliable electrical connection without interfering with the manufacture (and if necessary) reworking of the circuit board. In addition, a low loss cable can provide an attenuation of less than 5 dB up to 15 GHz at 1 meter or about 0.1 dB per inch (which is substantially better than a FR4 board). Thus, a connector system with a 10 inch cable can result in a loss of less than 6 dB (1 dB for the cable and 2.5 dB for each connector) and preferably less than 5 dB of loss (a more reasonably designed press-fit connector should have not more than about 2 dB of loss for each connector) and potentially only 3 dB of loss for the connector system (if the press-fit connector is well optimized it can have a loss of about 1 dB per connector) as compared to a solution routing through FR4 that would result in about 15 dB of loss just for the transmission line through the circuit board (and still would need to account for the loss in the connector).

As can be appreciated, the performance of the connector will depend on a number of factors and thus the loss in a channel between the silicon and the external interface will vary depending on those factors. It is expected, however, that for a 10 inch channel the connector system depicted herein will provide at least a 10 dB improvement compared to a design that uses FR4 circuit board to provide the 10 inch transmission channel, at least for signaling frequencies greater than 10 GHz. For example, the FR4 board is expected to provide a loss of about 15.5-16 dB for a 10 inch long channel at 13 GHz (e.g., 25 Gbps with NRZ encoding). In contrast, a connector system as disclosed herein can provide a loss of 5 dB at 13 GHz and a more optimized system can provide a solution that has a loss of about 3 dB at 13 GHz. Or to put it another way, the cable solution can potentially provide 1 dB of improvement compared to an FR4 based solution for each inch of distance between the silicon and the external interface in a system communicating at 13 GHz (assuming the communication length is at least 4 inches, for very short lengths it may be more desirable to simply provide a larger connector).

It should be noted that the discussed embodiments primarily discuss the signal terminals. In a functioning signaling system it is expected that at least one ground terminal will be associated with each signal pair in both connectors. In an embodiment, therefore, the ground terminals can be electrically connected to a ground wire (sometimes referred to as a drain wire) provided with the signal wires in an associated cable that extends between the first and second connector.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. A connector system, comprising:

a first connector having a first pair of signal terminals, each of the signal terminals including a first contact and a first tail, the contacts positioned in a card slot, the first connector further including a plurality of terminals configured to be press fit into a first circuit board region;

a second connector having a second pair of signal terminals configured to mate with a second circuit board region, the second circuit board region spaced apart from the first region; and a cable with a first end and a second end, the first end of the cable terminated to the tails of the first pair of signal terminals, the second end terminated to the second pair of signal terminals.

2. The connector system of claim 1, wherein the cable includes a ground wire and the ground wire is electrically connected to a first ground terminal in the first connector and a second ground terminal in the second connector.

3. The connector system of claim 2, wherein the first ground terminal has a contact positioned in the card slot adjacent the first pair of terminals.

4. The connector system of claim 3, wherein the first ground terminal is connected to the first circuit board region.

5. The connector of claim 3, wherein the ground wire is terminated to a U-shield and the U-shield is electrically connected to the first ground terminal.

6. The connector system of claim 1, wherein the first circuit board region is on a first circuit board and the second circuit board region is on a second circuit board.

7. A connector system, comprising:

a first connector that supports a first plurality terminals, the first plurality of terminals providing opposing contacts, a first set of terminals of the first plurality of terminals being configured as differential signal pairs and including tails, at least some of the first plurality of terminals configured to mate with a first circuit board region;

a second connector configured to mate with a second circuit board region, the second connector including a second plurality of terminals, a second set of terminals of the second plurality of terminals being configured as differential signal pairs; and a plurality of cables that each have a twin-axial construction connecting the tails of the first set of terminals to the second set of terminals, wherein each terminal of each of the differential signal pairs in the first connector are support by a separate wafer and each separate wafer supports terminals that form opposing contacts.

8. The connector system of claim 7, wherein the first connector provides a card slot that encloses the contacts of the first plurality of terminals.

9. The connector system of claim 7, wherein the plurality of cables each include a ground wire, wherein each of the ground wires connects a ground terminal in the first connector to a ground terminal in the second connector.

10. The connector system of claim 7, wherein the first circuit board region is part of a first circuit board and the second circuit board region is part of a second circuit board.

11. The connector system of claim 7, wherein the first and second circuit board regions are both part of the same circuit board.

* * * * *